US007854097B2

(12) United States Patent
Schlyper et al.

(10) Patent No.: US 7,854,097 B2
(45) Date of Patent: Dec. 21, 2010

(54) SIMULATED DIVIDED LIGHT PRODUCTS AND PROCESSES AND SYSTEMS FOR MAKING SUCH PRODUCTS

(75) Inventors: Omer Theodore Schlyper, Klamath Falls, OR (US); Gary Phillip Gardner, Redmond, OR (US); Jerry Dean Jones, Klamath Falls, OR (US)

(73) Assignee: JELD-WEN, Inc., Klamath Falls, OR (US)

( * ) Notice: Subject to any disclaimer, the term of this patent is extended or adjusted under 35 U.S.C. 154(b) by 1107 days.

(21) Appl. No.: 11/035,544

(22) Filed: Jan. 14, 2005

(65) Prior Publication Data

US 2005/0188630 A1 Sep. 1, 2005

Related U.S. Application Data

(60) Provisional application No. 60/537,051, filed on Jan. 16, 2004.

(51) Int. Cl.
*E06B 3/30* (2006.01)
*E06B 3/964* (2006.01)

(52) U.S. Cl. ..... 52/204.53; 52/204.61

(58) Field of Classification Search ..... 52/204.53, 52/204.61, 204.67; 49/61, 63, 125, 504
See application file for complete search history.

(56) References Cited

U.S. PATENT DOCUMENTS 3,411,258 A * 11/1968 Kessler ..... 52/456
3,623,648 A * 11/1971 Newswanger ..... 227/143
3,708,939 A * 1/1973 Herr ..... 52/456
4,179,707 A 12/1979 Sjodin
4,192,905 A * 3/1980 Scheibal ..... 428/80
4,437,284 A 3/1984 Cribben et al.
4,558,536 A * 12/1985 Dunsmoor ..... 49/404
4,586,306 A * 5/1986 Webb ..... 52/204.61
4,665,663 A * 5/1987 Governale ..... 52/456
4,844,968 A 7/1989 Persson et al.
4,879,752 A 11/1989 Aune et al.
4,970,840 A 11/1990 Ouellette et al.
4,989,384 A * 2/1991 Kinghorn et al. ..... 52/456
5,050,359 A 9/1991 Lorge et al.
5,086,596 A 2/1992 Schlyper et al.
5,088,533 A 2/1992 Binder
5,105,591 A 4/1992 Leopold (Continued)

FOREIGN PATENT DOCUMENTS

EP 0496968 A1 8/1992

(Continued)

OTHER PUBLICATIONS

International Search Report, dated Dec. 1, 2006.

(Continued)

*Primary Examiner*—Richard E Chilcot, Jr.
*Assistant Examiner*—Andrew J Triggs
(74) *Attorney, Agent, or Firm*—Stoel Rives LLP

(57) ABSTRACT

Disclosed are simulated divided light products and processes and systems for making the such products. One product discloses simulated divided light bars that are designed such that the end of the bar may be fitted into a notched sash to provide for the automated method for manufacture of a simulated divided light window or door.

22 Claims, 11 Drawing Sheets

U.S. PATENT DOCUMENTS 5,141,110 A 8/1992 Trischan et al.
5,183,622 A 2/1993 Persson
5,189,490 A 2/1993 Shetty et al.
5,291,710 A * 3/1994 Golen ..... 52/311.1
5,299,396 A * 4/1994 Rap et al. ..... 52/90.1
5,331,727 A * 7/1994 Golen ..... 29/453
5,345,743 A 9/1994 Baier
5,361,476 A 11/1994 Leopold
5,394,342 A 2/1995 Poon
5,418,608 A 5/1995 Caimi et al.
5,428,924 A * 7/1995 Pifer ..... 49/50
5,477,647 A * 12/1995 Yates, Jr. ..... 52/204.57
5,487,245 A * 1/1996 Dazo et al. ..... 52/204.61
5,494,715 A 2/1996 Glover
5,501,888 A 3/1996 Hanson et al.
5,555,684 A 9/1996 Galowitz et al.
5,603,585 A 2/1997 Bruchu et al.
5,608,527 A 3/1997 Valliant et al.
5,761,070 A 6/1998 Conners et al.
5,791,215 A 8/1998 Morrison et al.
5,836,119 A 11/1998 Emmanuel
5,840,391 A 11/1998 Eichhorn et al.
5,953,232 A 9/1999 Blaimschein
5,980,667 A * 11/1999 Reeder et al. ..... 156/109
6,085,481 A * 7/2000 Lee ..... 52/656.8
6,092,343 A 7/2000 West et al.
6,128,871 A * 10/2000 Corey ..... 52/204.61
6,133,948 A 10/2000 Abbott et al.
6,137,577 A 10/2000 Woodworth
6,160,479 A 12/2000 Ählen et al.
6,167,662 B1 1/2001 Gruber
6,177,156 B1 1/2001 Glover et al.
6,222,628 B1 4/2001 Corallo et al.
6,230,456 B1 * 5/2001 Merchlewitz ..... 52/204.61
6,240,685 B1 * 6/2001 Eichhorn ..... 52/204.61
6,244,012 B1 6/2001 McGlinchy et al.
6,244,013 B1 * 6/2001 Lee ..... 52/667
6,295,737 B2 10/2001 Patton et al.
6,298,275 B1 10/2001 Herman, Jr.
6,380,503 B1 4/2002 Mills et al.
6,415,579 B1 * 7/2002 Reeder et al. ..... 52/786.13
6,425,221 B1 * 7/2002 Reichert ..... 52/456
6,438,819 B1 * 8/2002 McGlinchy et al. ..... 29/564.6
6,441,908 B1 8/2002 Johnston et al.
6,546,127 B1 4/2003 Seong et al.
6,636,310 B1 10/2003 Ben-Dov et al.
6,651,304 B2 11/2003 McGlinchy et al.
6,674,517 B2 1/2004 Yamaguchi et al.
6,678,062 B2 1/2004 Haugen et al.
6,684,474 B2 * 2/2004 Reichert ..... 29/407.05
6,718,704 B2 * 4/2004 Plummer et al. ..... 52/204.61
6,868,596 B2 * 3/2005 Reichert ..... 29/407.05
6,883,278 B2 * 4/2005 McGlinchy et al. ..... 52/204.61
6,898,914 B2 * 5/2005 Folsom et al. ..... 52/656.8
7,051,445 B1 5/2006 Karapetyan
7,100,335 B2 * 9/2006 Plummer et al. ..... 52/204.61
7,318,301 B2 * 1/2008 Reeder et al. ..... 52/204.61
7,370,454 B2 5/2008 Lynch et al.
2001/0034990 A1 * 11/2001 Reichert ..... 52/456
2002/0085093 A1 7/2002 Frigon et al.
2002/0112422 A1 * 8/2002 Plummer et al. ..... 52/204.61
2002/0166297 A1 * 11/2002 Plummer et al. ..... 52/204.61
2003/0126812 A1 * 7/2003 Folsom et al. ..... 52/204.62
2004/0216402 A1 * 11/2004 Folsom et al. ..... 52/204.53
2005/0086880 A1 * 4/2005 Polowinczak ..... 52/204.62
2005/0188630 A1 * 9/2005 Schlyper et al. ..... 52/204.1

FOREIGN PATENT DOCUMENTS

EP 1093899 A1 4/2001
JP 62157758 7/1987
JP 05180638 7/1993
WO WO 9011488 10/1990
WO WO 9222786 12/1992
WO WO 98/57797 12/1998
WO WO 03/027783 A1 4/2003

OTHER PUBLICATIONS

PCT International Preliminary Report on Patentability of corresponding International Application No. PCT/US2006/012897, mailed Oct. 25, 2007.

* cited by examiner

SIMULATED DIVIDED LIGHT PRODUCTS AND PROCESSES AND SYSTEMS FOR MAKING SUCH PRODUCTS

PRIORITY CLAIM

The present application claims priority to U.S. Provisional Patent Application Ser. No. 60/537,051, filed Jan. 16, 2004. The entire disclosure of 60/537,051 is incorporated by reference in its entirety herein.

FIELD OF INVENTION

The present invention relates to simulated divided light products and processes and systems for making such products.

BACKGROUND

Multi-paneled glass windows and doors are often used for construction because of their aesthetically pleasing appearance. Originally, multi-paneled glass windows and doors were made using a grid of interconnecting bars, or muntins, to provide a plurality of square or rectangular openings into which individual panes of glass were inserted. Such panels may be referred to as true divided light, in that the glass panes were actually separate, individual pieces of glass. To avoid leaks in the windows and/or doors, the glass panels had to be cut and fitted to the muntin grid with precision.

To simplify the manufacturing process, and to reduce the tendency for leaks to develop at the junction between the window pane and the muntins, most manufacturers now use a grid of interlocking muntins applied to the surface of a single glass pane so as to seemingly divide a single large window pane into multiple smaller panes. Such structures may be referred to as simulated divided light (SDL) structures. Thus, a single glass pane may be used to provide a simulated divided light (SDL) window or door. The muntin bars that are applied to a surface of the transparent panel to thereby divide that surface may be termed simulated divided light (SDL) bars.

SDL bars may be applied to single-paned windows or to double-paned windows. For a double-paned window, the SDL bars may be suspended within the glass cavity between the two panes. For example, as described in U.S. Pat. Nos. 5,494,715 and 6,177,156, the SDL bars may be designed as relatively thin strips that are taped to the inner surface of two adjacent glass panes and aligned to appear to be a single muntin grid that spans the entire volume between the two panes of glass. Alternatively, SDL bars may be adhered to the outwardly facing surface of a glass pane, in either a single-paned or a double-paned window, using tape or a similar adhesive. The use of SDL bars that are attached to the surface of glass panes (as opposed to truly dividing the glass) has the additional advantage of allowing different materials to be used for exterior SDL bars (e.g., aluminum) versus interior SDL bars (e.g., wood).

The application of a grid of interlocking SDL bars to the surface of a glass pane in a window or door is less labor-intensive than the manufacture of true divided light windows and doors, but still requires extensive labor to properly align the bars with the window sash and/or door panel. The fit of each individual bar may need to be adjusted due to small fluctuations in linearity or sizing of either the individual bars, or the surrounding window sash or door panel. Generally, the assembly of a grid of SDL bars within the sash of a window or the panel of a door requires measuring each of the bars in the grid at multiple steps along the process. If any one bar is misaligned, the error may be promulgated throughout the entire grid, sometimes necessitating that the newly manufactured product be discarded. Also, whereas positioning the grid on a small window may be fairly straightforward, larger grids, such as those used for a patio door, may require adjustment at several points along each SDL bar. For example, each time any one part of the grid is adjusted it may be necessary to measure and re-measure the grid at other places along the pane. Because the process of applying SDL grids to windows or doors can be highly labor-intensive, it may become a bottleneck in the production process, slowing down the entire production line.

Thus, there is a need for simplified processes and systems to manufacture simulated divided light windows and doors.

SUMMARY OF THE INVENTION

Embodiments of the present invention comprise simulated divided light products and processes and systems for making the such products. The present invention may be embodied in a variety of ways.

One embodiment of the present invention comprises a process for emplacing a simulated divided light bar on a panel, wherein at least a portion of the panel comprises at least one transparent section. The process may comprise the step of making an aperture at a predetermined position in the panel. Also, the process may comprise the step of inserting a first portion of the simulated divided light bar in the aperture made in the panel, such that a second portion of the bar is positioned adjacent to, and divides at least part of, the transparent section into at least two smaller sections.

The simulated divided light bars may be assembled into a grid prior to emplacing the bars onto a panel. Thus, another embodiment of the process may comprise preparing a plurality of simulated divided light bars wherein at least one bar comprises at least one end having a protruding element, and assembling at least two of the simulated divided light bars to form a grid. The method may further comprise making at least one aperture in at least one predetermined position in the panel for insertion of a simulated divided light bar. Next, the method may comprise aligning each of the protrusions on the simulated divided light bars with an aperture in the panel, and inserting at least a portion of each of the protrusions on the simulated divided light bars into a corresponding aperture in the panel, such that the grid is adjacent to, and divides at least part of, the transparent section into a plurality of smaller sections.

Other embodiments of the present invention comprise products comprising a simulated divided light panel. One embodiment of the product may comprise a simulated divided light bar comprising a protrusion on at least one end of the bar, and a panel, wherein at least part of the panel comprises a transparent section, and at least one aperture into which at least a portion of the protrusion on the simulated divided light bar is inserted so as to divide a surface of the transparent section into at least two smaller sections.

Embodiments of the present invention also comprise processes for automated notching of a panel. One embodiment of the process may comprise the steps of identifying a first panel based at least in part on a first parameter, the first panel comprising an attribute; determining whether an assembly will be applied to the first panel; verifying that the assembly will be applied to the first panel; and forming a pattern of notches in a sash of the first panel corresponding with a configuration of the assembly, the notches adapted to accept portions of the assembly.

Other embodiments of the present invention may comprise computer-readable medium on which is encoded program code for automated notching of a panel. One embodiment of the program code may comprise program code for identifying a first panel based at least in part on a first parameter, the first panel comprising an attribute; program code for determining whether an assembly will be applied to the first panel; program code for verifying that the assembly will be applied to the first panel; and program code for forming a pattern of notches in a sash of the first panel corresponding with a configuration of the assembly, the notches adapted to accept portions of the assembly.

Other embodiments of the present invention comprise systems for the manufacture of SDL products. For example, one embodiment of the system comprises a notching apparatus adapted to form a pattern of notches in a sash of a first panel of a plurality of panels, the pattern of notches corresponding to a configuration of an assembly of simulated divided light bars; a first processor adapted to control the notching apparatus; and a second processor in operative communication with the first processor, the second processor adapted to communicate to the first processor a first parameter of the first panel.

Yet other embodiments of the present invention comprise systems for producing a simulated divided light panel. One example of the system comprises an apparatus to make at least one aperture in a portion of a panel at a predetermined position, wherein the position of the aperture is selected for insertion of a portion of a simulated divided light bar. The system may further include an apparatus to make at least one protrusion at an end of a simulated divided light bar. Also, the system may include a station where the simulated divided light bar comprising at least one protrusion and the panel comprising at least one aperture are assembled as a simulated divided light product by inserting the protrusion on the simulated divided light bar into the aperture on the panel.

Certain embodiments of the present invention may offer certain advantages. For example, the present invention may provide for increased precision and speed in the manufacture of simulated divided light (SDL) products. Rather than having to manually align and position each juncture where the SDL bars intersect with a window sash or a door panel, the processes of the present invention allow for rapid assembly of the SDL product by aligning a SDL grid with a panel, and inserting the protruding ends on the SDL bars into corresponding apertures on the sash or door panel. Also, using the method of the present invention, a plurality of SDL bars assembled as a grid may be positioned in the panel almost simultaneously. Thus, there is a substantial reduction in the amount of positioning, and re-positioning, required to emplace a grid of SDL bars on a panel.

The present invention may provide for an improved SDL product. Interlocking a protrusion on the end of a SDL bar with an aperture in the surrounding panel may provide an extra level of stability not previously present where SDL grids were merely positioned within the perimeter of the sash (or door panel) and taped to the window. This extra level of support may help to prevent warping of wooden SDL bars that may occur when the wood is exposed to excessively hot and dry or moist environments.

The traditional method of positioning SDL bars on a panel may require continual adjustment and re-adjustment as the SDL grids are positioned within a divided light panel, such that the step of placing a grid within a window sash or door panel can become a bottleneck in the overall production process. This bottleneck can slow down the entire assembly process, leading to accumulation of unfinished products, and inefficient use of labor upstream and downstream of the bottleneck. As a result, there may be a need to schedule (or reschedule) assembly of simulated divided light panels during "slow" periods, when there is ample time and labor resources required for the assembly process. Using the processes and systems of the present invention, there may be reduced variability in aligning SDL grids within the surrounding window sash or door panel such that multi-paneled windows and doors may be produced in an efficient and cost-effective manner. Thus, the present invention may provide for increased efficiency of the entire production line for assembly of SDL panels.

Also, the processes and systems of the present invention may be automated. For example, in one embodiment, the system may employ an automated notching apparatus that can be programmed to place notches in a preselected position of an assembled window sash or door panel. Automation of the assembly process can significantly increase the utilization of the labor force and the efficiency of production. Such increases in manufacturing efficiency and labor utilization may be associated with reduced costs of production and thus, a more affordable product for the consumer.

The present invention may be better understood by reference to the description and figures that follow. It is to be understood that the invention is not limited in its application to the specific details as set forth in the following description and figures. The invention is capable of other embodiments and of being practiced or carried out in various ways.

DETAILED DESCRIPTION

Figure 1:
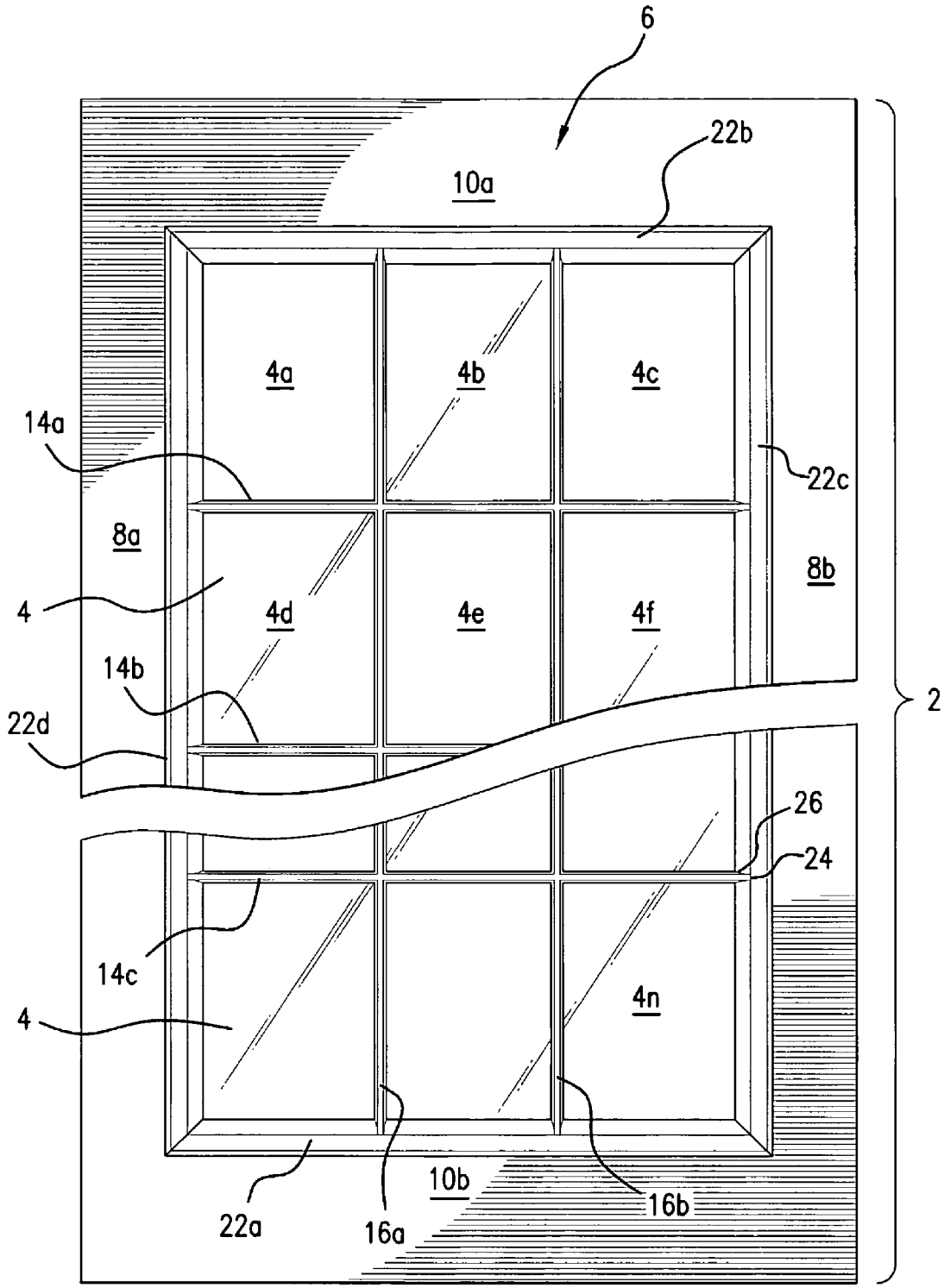
FIG. 1 is a representation of a multi-paneled door in accordance with an embodiment of the present invention.

Embodiments of the present invention comprise simulated divided light products, such as multi-paned glass windows and doors, and processes and systems for making the such products. One embodiment of the present invention comprises a process for emplacing a simulated divided light bar on a panel, wherein at least part of the panel includes at least one transparent section, comprising the steps of making an aperture at a predetermined position in the panel, and inserting a first portion of the simulated divided light bar in the aperture, such that a second portion of the bar is positioned adjacent to, and divides at least part of, the transparent section into at least two smaller sections.

The term "a" or "an" as used herein may refer to more than one object unless the context clearly indicates otherwise. The term "or" is used interchangeably with the term "and/or" unless the context clearly indicates otherwise. Also, as used herein, a panel comprises a structure that is substantially thinner along one axis that the other two axes. The panel may include a framework that surrounds a central portion. Included in the panels of the present invention are windows, which may include a transparent window pane surrounded by a sash. Also included in the panels of the present invention are doors, which may include a transparent window pane surrounded by a door panel. The door panel and/or sash may include horizontal rails and vertical stiles as is known in the art. Also, the door panel and sash may include a glass stop.

Also as used herein, a SDL bar, or muntin, is a bar or strip of non-transparent material that may be used to divide a transparent panel into sections. The SDL bars may be assembled into a grid. As used herein, a grid of SDL bars comprises SDL bars that are attached to each other, where the point of attachment is not at the end of any of the bars.

A variety of apertures may be made in the panel. In one embodiment, the aperture is a rectangular-shaped notch. Alternatively, the aperture may comprise a slit, a cylinder, a triangular shaped wedge, or the like.

The processes of the present invention allow for the manufacture of simulated divided light (SDL) products without requiring repetitive measuring and re-measuring of either the SDL bars or the panels as was typical of manufacturing systems previously used. In one embodiment, the bars may be fashioned so as to fit into notches made in the panel onto which the bars are to be emplaced. In one embodiment, the portion of the bar inserted into the aperture comprises a protrusion on the end of the bar that fits into the aperture on the panel. Protrusions may comprise a variety of shapes, such as expandable pins, cylinders comprising annular stops for insertion into a cylindrical aperture, and the like. In one embodiment, the protrusion may comprise a wedge shaped like a right triangle that may be inserted into a rectangular notch cut into a glass stop, window sash, or door panel.

The number of apertures placed in the surrounding panel may vary depending on the type of divided-light panel being made. In an embodiment, a single aperture may be sufficient. In alternate embodiments, a plurality of apertures may be used. The apertures may be placed vertically or horizontally along the surrounding panel. For example, for a window sash, the apertures may be placed at predetermined positions along one or both stiles of the window sash. Alternatively, or additionally, notches may be placed horizontally along one or both rails of the sash. In one embodiment where a plurality of notches are used, the SDL grid may comprise a plurality of matching protruding elements.

By inserting a portion of the SDL bar into a corresponding aperture in the panel, the bar may be securely fixed within the panel. In one embodiment, two apertures are made for each SDL bar that is emplaced on the panel. In this way, upon emplacement of the SDL bar on the panel, the SDL bar may be fixed in place at each end.

The processes of the present invention allow for a grid of SDL bars to be emplaced on the panel. Thus, in one embodiment, at least two simulated divided light bars are attached to each other to form a grid prior to emplacing the bars on the panel. Where the SDL bars are assembled as a grid prior to emplacement in the panel, a plurality of apertures may be made in the panel for insertion of a plurality of protrusions on the ends of the bars that form the grid. Having a plurality of apertures in the panel may allow a grid of SDL bars to be emplaced in the panel in one step, such that insertion of the protrusions on the ends of the bars in the grid into the corresponding apertures in the panel may substantially simultaneous.

For example, one embodiment of the present invention comprises a process of emplacing a grid of simulated divided light bars on a panel, wherein the panel comprises at least one transparent section comprising the steps of: (a) preparing a plurality of simulated divided light bars wherein at least one bar comprises at least one end having a protruding element; (b) assembling at least two of the simulated divided light bars to form a grid; (c) making at least one aperture at a predetermined position in the panel; (d) aligning each of the protrusions on the simulated divided light bars with an aperture in the panel; and (e) inserting at least a portion of each of the protrusions on the simulated divided light bars into a corresponding aperture in the panel, such that the grid is emplaced adjacent to, and divides at least part of, the transparent section into a plurality of smaller sections. In one embodiment, the step of positioning and forming the apertures in the panel is controlled at least in part by a computer. Also, in one embodiment, a plurality of apertures are made in the panel for insertion of a plurality of protrusions on the ends of a grid of simulated divided light bars. Insertion of the protrusions on the ends of the plurality of simulated divided light bars into the corresponding apertures in the panel may be substantially simultaneous.

The processes of the invention may be used to make a variety of SDL products. For example, in one embodiment, the portion of the panel having the aperture may comprise a window sash, such that when the bar is emplaced, the window may comprise a SDL window. Or, the portion of the panel having the aperture may comprise a glass stop positioned adjacent to a window sash, such that when the bar is emplaced, the window may comprise a SDL window. In another embodiment, the portion of the panel having the aperture may comprise a door panel such that when the grid is emplaced, the door may comprise a SDL door. Or, the portion of the panel having the aperture may comprise a glass stop positioned adjacent to a door panel, such that when the bar is emplaced, the window may comprise a SDL door.

As the method may be used in the manufacture of windows and doors, the interlocking SDL grid and the panels into which they are inserted may be made from materials commonly used for the manufacture of windows and doors. In alternative embodiments, the SDL bars may be made from wood, vinyl, or metal (e.g., aluminum) Also, the surrounding panel (e.g., window sash or door panel) may, in alternative embodiments, be made from wood, vinyl, or metal. In one embodiment, the panel may comprise one material used for the inside surface and a second material for the outside surface. For example, many glass windows and doors may have a wooden sash and SDL grid on the interior surface, and a metal or vinyl sash and SDL grid on the exterior surface.

The process may further include the step of adhering the SDL bars to the transparent panel. For example, a liquid adhesive may be used to adhere the SDL bars to the transparent section of the panel. Or, sticky tape may be applied to the surface of the SDL bar that is positioned adjacent to the transparent section of the panel. In one embodiment, the sticky tape that is used may allow for adjustment during the positioning of the SDL bars on the transparent panel.

Embodiments of the present invention comprise articles of manufacture made using the processes of the invention. For example one embodiment of the present invention comprises a product comprising a simulated divided light panel comprising a simulated divided light bar comprising a protrusion on at least one end of the bar, and a panel wherein at least part of the panel includes at least one transparent section, and comprising at least one aperture into which at least a portion of the protrusion on the simulated divided light bar is inserted so as to divide a surface of the transparent panel into at least two smaller sections.

A variety of apertures may be made in the panel. In one embodiment, the aperture is a rectangular-shaped notch. Alternatively, the aperture may comprise a slit, a cylinder, or a triangular shaped wedge.

The products of the present invention may be made without the repetitive measuring and re-measuring of either the SDL bars or the panels as was typical of manufacturing systems previously used. The bars may be designed to fit into notches made in the panel onto which the bars are to be emplaced. In one embodiment, the portion of the bar inserted into the aperture comprises a protrusion on the end of the bar that fits into the aperture. Protrusions may comprise a variety of shapes, such as expandable pins, cylinders comprising annular stops for insertion into a cylindrical aperture, and the like. In one embodiment, the protrusion may comprise a wedge shaped like a right triangle that may be inserted into a rectangular notch cut into a glass stop, window sash, or door panel.

The number of apertures placed in the surrounding panel may vary depending on the type of divided-light panel being made. In an embodiment, a single aperture may be sufficient. In alternate embodiments, a plurality of apertures may be used. The apertures may be placed vertically or horizontally along the surrounding panel. For example, for a window sash, the apertures may be placed at predetermined positions along one or both stiles of the window sash. Alternatively, or additionally, notches may be placed horizontally along one or both rails of the sash. In one embodiment, where a plurality of notches are used, the SDL grid may comprise a plurality of matching protruding elements.

By inserting a portion of the SDL bar into a corresponding aperture in the panel, the bar may be securely fixed within the panel. In one embodiment, two apertures are made for each SDL bar that is emplaced on the panel. In this way, upon emplacement of the SDL bar on the panel, the SDL bar may be fixed in place at each end.

The SDL bars emplaced on the panel may be formed to be a grid. Thus, in one embodiment, at least two simulated divided light bars are attached to each other to form a grid prior to emplacing the bars on the panel. Where the SDL bars are assembled as a grid prior to emplacement in the panel, a plurality of apertures may be made in the panel for insertion of a plurality of protrusions on the ends of the bars that form the grid. Having a plurality of apertures in the panel may allow a grid of SDL bars to be emplaced in the panel in one step, such that insertion of the protrusions on the ends of the bars in the grid into the corresponding apertures in the panel may substantially simultaneous.

The processes of the invention may be used to make a variety of SDL products. For example, in one embodiment, the portion of the panel having the aperture may comprise a window sash, such that when the bar is emplaced, the window may comprise a simulated divided light window. Or, the portion of the panel having the aperture may comprise a glass stop positioned adjacent to a window sash, such that when the bar is emplaced, the window may comprise a simulated divided light window. In another embodiment, the portion of the panel having the aperture may comprise a door panel such that when the grid is emplaced, the door may comprise a simulated divided light door. Or, the portion of the panel having the aperture may comprise a glass stop positioned adjacent to a door panel, such that when the bar is emplaced, the window may comprise a simulated divided light door.

The interlocking SDL grid and the panels into which they are inserted may be made from materials commonly used for the manufacture of windows and doors. In alternative embodiments, the SDL bars may be made from wood, vinyl, or metal (e.g., aluminum) Also, the surrounding panel (e.g., window sash or door panel) may, in alternative embodiments, be made from wood, vinyl, or metal. The product may further comprise a first SDL bar applied to one surface of the panel, and a second SDL bar applied to the second surface of the panel. In one embodiment, the panel may comprise one material used for the inside surface and a second material for the outside surface. For example, many glass windows and doors may have a wooden sash and SDL grid on the interior surface, and a metal or vinyl sash and SDL grid on the exterior surface.

Embodiments of the present invention also comprise systems for the manufacture of SDL products. For example, one embodiment of the system comprises an apparatus to make at least one aperture in a portion of a panel at a predetermined position, wherein the position of the aperture is selected for insertion of a portion of a simulated divided light bar; an apparatus to make at least one protrusion at an end of a simulated divided light bar; and a station where the simulated divided light bar comprising at least one protrusion and the panel comprising at least one aperture are assembled as a simulated divided light product by inserting at least a portion of the protrusion on the simulated divided light bar into the aperture on the panel. In one embodiment, a plurality of apertures in the panel are aligned with the protrusions on the ends of a plurality simulated divided light bars such that each simulated divided light bar can be at least partly inserted into a corresponding aperture in the panel. Also in one embodiment, the aperture is a notch.

The notching apparatus may be automated. For example, the notching apparatus may be controlled by a computer. In an embodiment, the notching apparatus comprises a computer program and related software to determine whether a panel (e.g., sash or door panel) should be notched, and if so, where along the panel the notches should be positioned.

The system may be controlled remotely via a centralized computer program. Additionally, the system may have internal software to allow for adjustment of the product being made. In an embodiment, the notching apparatus measures the simulated divided-light panel to gauge the correct position for the aperture. For example, in one embodiment, a laser may be used to measure the window sash or door panel. Also, in an embodiment, photo eyes, proximity devices, and optics eyes can be used in conjunction with servo driven lineal positioning devices as is known in the art. Alternatively, other methods known in the art, such as robotic measurement and the like, may be used for the determination of the position of the aperture. The measurements can be used to verify that the sash or panels are within the specifications given by the database for the product being made. For example, in an embodiment, a manufacturing resource planning database may be used.

The number of notches placed in the surrounding panel may vary depending on the type of divided-light panel being made. In an embodiment, the notching apparatus determines whether a single notch may be sufficient, or whether a plurality of notches is required based on the simulated divided-light product being made. As described herein, the notches may be placed vertically and/or horizontally along the surrounding panel. For example, for a window sash, the notches may be placed vertically, at predetermined positions along one or both of the stiles of the window sash and/or door panel, and/or notches may be placed horizontally, along one or both rails of the sash and/or door panel, and/or notches may be placed along both the vertical and/or horizontal glass stops. In one embodiment, where a plurality of notches are employed, the SDL bar grid will also comprise a plurality of matching protruding elements.

The system may also include a station to assemble a plurality of the SDL bars as a grid prior to attaching the bars to the panel. In one embodiment, the station for assembly a grid of SDL bars may be positioned prior to the station for notching the panel to receive the grid. Also, a plurality of apertures may be made in the panel for insertion of a plurality of protrusions on the ends of the intersecting simulated divided light bars formed as a grid.

Once the grid has been assembled, and the panel has been appropriately notched, both parts may be transferred to a station where the grid assembly is emplaced in the notched panel. In one embodiment, insertion of the protrusions on the ends of the plurality of simulated divided light bars into the corresponding notches in the panel is substantially simultaneous such that once the protrusions on the grid of SDL bars are aligned with the notches on the panel, there is no need to measure or readjust placement of the grid prior to inserting the protrusions on the SDL bars into the notches in the panel.

The system is designed for the manufacture of a variety of SDL products. In one embodiment, the portion of the panel having the aperture may comprise a window sash, such that when the bar is emplaced, the window may comprise a simulated divided light window. Alternatively, the portion of the panel having at least one aperture may comprise a glass stop positioned adjacent to a window sash, such that when the bar is emplaced, the window may comprise a simulated divided light window. Or, the portion of the panel having the aperture may comprise a door panel such that when the grid is emplaced, the door comprises a simulated divided light door. In yet another embodiment, the portion of the panel having at least one aperture may comprise a glass stop positioned adjacent to a door panel, such that when the bar is emplaced, the window comprises a simulated divided light door.

Automated Production of Simulated Divided Light Products

Although more efficient than the use of true divided panes, the application of interlocking simulated divided light (SDL) bars (e.g., muntin bars) to the surface of a glass pane in a window or door requires extensive labor to properly align the individual bars with the glass stop, window sash, or door panel. Generally, assembly of a grid of SDL bars within the sash of a window or the panel of a door requires measuring each bar at multiple steps of the process. For example, there may be fluctuations in linearity and/or size due to bowing of individual bars, or slight inaccuracies of the surrounding window sash or door panel. If any one portion of the grid, or the surrounding panel, is misaligned, the error may be magnified as the grid is assembled and positioned in the panel. The difficulty in aligning a grid of interlocking SDL bars may be exacerbated in large multi-paneled windows and doors, such as picture windows or patio door assemblies, as it may be difficult to align individual sections of the grid. Thus, assembly of SDL products can be relatively inefficient and/or labor intensive compared to other steps of window and door manufacture.

Thus, the present invention provides processes and systems to improve the efficiency of production of SDL panels, such as multipaned windows and doors. As shown in FIG. 1, a simulated divided light panel 2 may comprise a glass pane 4 surrounded by a sash 6. The glass pane 4 may comprise a single glass pane or a double glass pane, where the pane fills the area surrounded by the sash. As used herein, a sash comprises a frame used to hold glass in a window that may slide up and down (or side to side) in the grooves of a window aperture. Alternatively, the glass pane is used in a door, and is surrounded by a door panel. The sash (or door panel) is comprised of two vertical stiles, 8*a* and 8*b*, and two horizontal rails, 10*a* and 10*b*. Within the sash 6 and attached thereto, are horizontal SDL bars (e.g., muntins), e.g., 14*a*, 14*b*, and 14*c*, and vertical SDL bars, e.g., 16*a* and 16*b*. As used herein, SDL bars, or muntins, comprise non-transparent strips or bars that are used to divide a transparent panel into sections. The set of interlocking SDL bars (e.g., 14*a*, 14*b*, 14*c*, 16*a*, and 16*b*) can be seen to resemble a grid. It can be seen that the SDL bars appear to segment the pane of glass 4 into separate quadrants or sections (e.g., 4*a*, 4*b*, 4*c*, etc., depending on the number of SDL bars).

In one embodiment, the SDL bars may be attached to only one surface of the glass pane. Alternatively, SDL bars may be positioned on both sides of a single or double glass pane. Also, for double paned windows, SDL bars may be placed in between the inwardly facing surfaces of the two glass panes.

There may be a glass stop 22 positioned to overly the junction of the sash 6 and the window 4 (FIG. 1). The glass stop 22 may comprise four strips, 22*a*, 22*b*, 22*c*, and 22*d*, generally made of the same material as is used for the sash or door panel. The strips that make up the glass stop may be applied around the perimeter of the glass 4 and flush to the surrounding sash or door panel 6. The stop 22 may cover the junction between the glass pane and the surrounding sash or door panel as well as any visible adhesive from view, and thus, can provide an attractive boundary around the glass.

In an embodiment, there are apertures, such as notches 24, positioned in the glass stop 22 at predetermined positions, where the position of the notch 24 corresponds to the position for insertion of the SDL bar (FIG. 1). The SDL bars may comprise a protrusion 26, such as a bump having the shape of a right triangle that may be inserted in one of the notches 24 in the glass stop 22. Although the actual notches 24 and protrusions 26 cannot be seen in FIG. 1, their positions are indicated. In an embodiment, the notches are placed at predetermined positions along the vertical stiles 8*a*, 8*b* that comprise the sash and/or the vertical glass stop 22*c*, 22*d* for insertion of horizontal muntin bars. Alternatively, notches may be made in the horizontal rails 10*a*, 10*b* of the sash, and/or the horizontal glass stop 22*a*, 22*b*, for insertion of vertical muntin bars. Also, notches 24 may be made along both the vertical and horizontal portions of the glass stop, sash, or door panel, for insertion of horizontal and vertical SDL bars.

Figure 2:
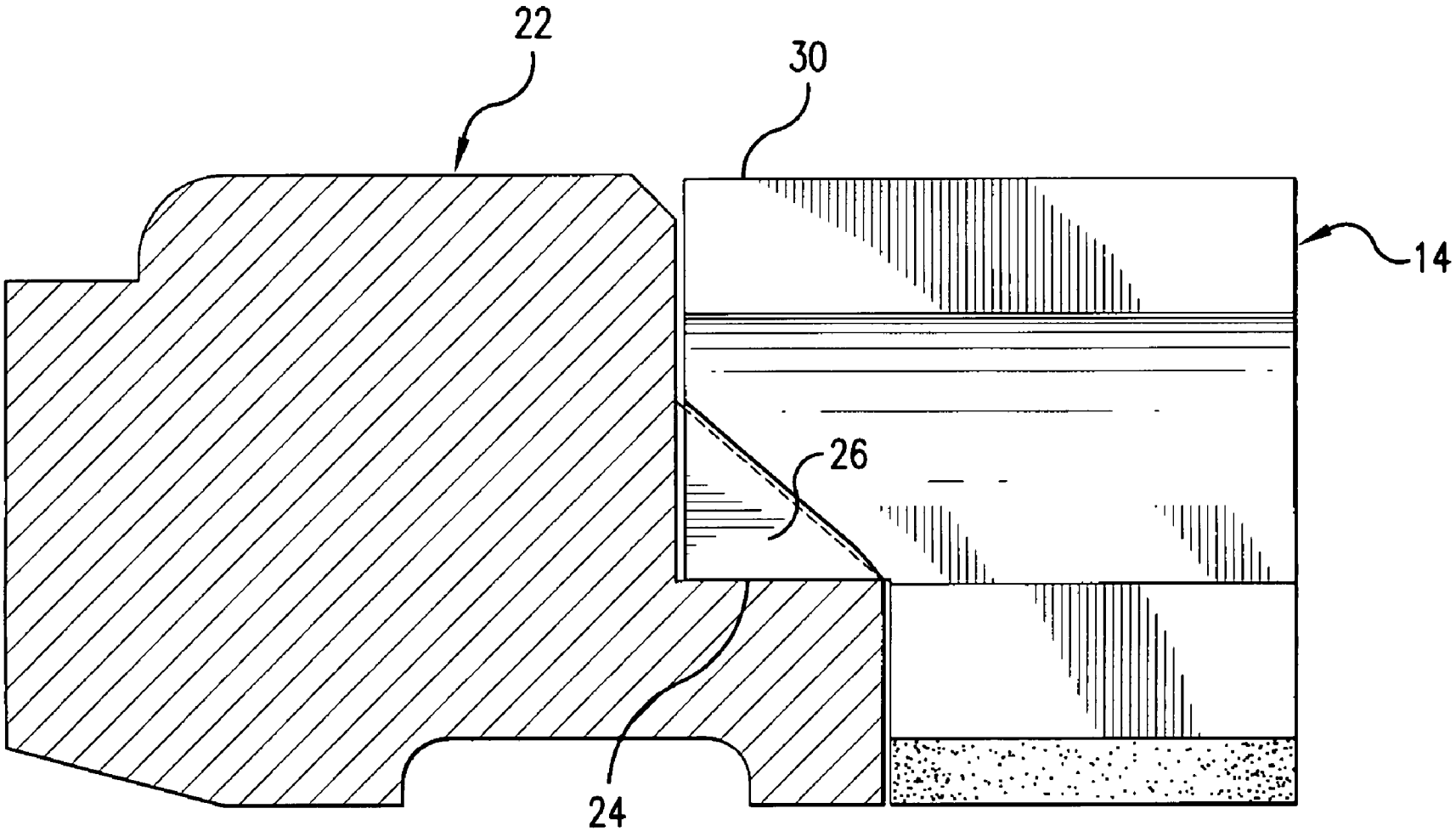
FIG. 2 shows a sectional view representation of a wedge-shaped protrusion at the end of a simulated divided light bar inserted into a notch in a glass stop of a window sash in accordance with an embodiment of the present invention.

FIG. 2 shows a representation of an embodiment of a SDL bar or muntin 14 having a protrusion 26 at the end of the bar for insertion into a notch 24 of a glass stop 22 of a window sash or door panel. In this figure, for orientation purposes, the SDL bar is depicted as a horizontal SDL bar 14. Alternatively or additionally, the vertical SDL bars may comprise protrusions 26. As shown in FIG. 2, the SDL bar 14 may be shaped such that when the protrusion 26 on the SDL bar is inserted into the notch 24 in the glass stop, a substantially flush intersection between the glass stop 22 and the top side 30 of the SDL bar is created.

Figure 3:
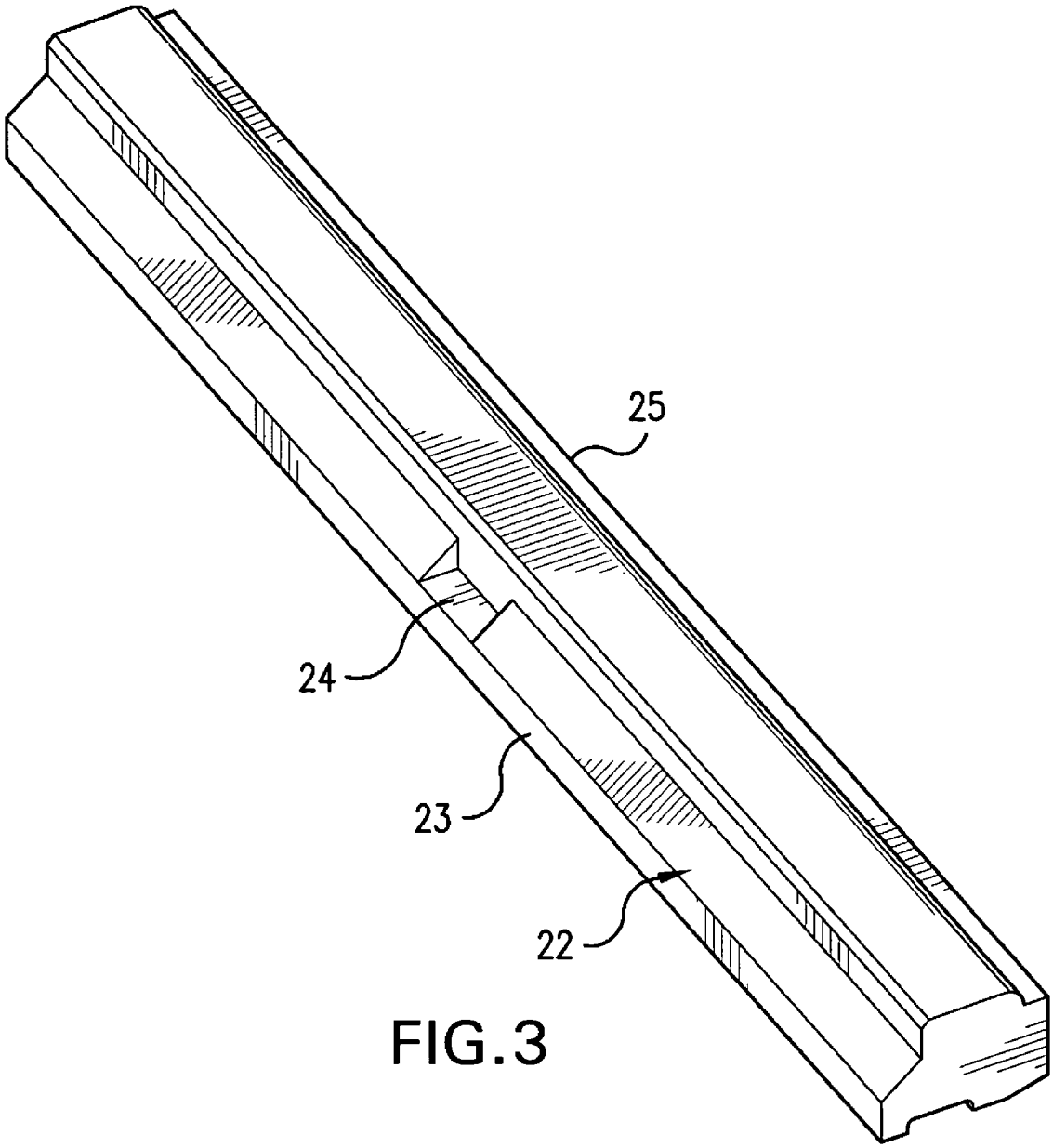
FIG. 3 shows a representation of a notched window sash in accordance with an embodiment of the present invention.

FIG. 3 shows a representation of an embodiment of a glass stop 22 comprising a notch 24. The glass stop comprises an inner edge 23 that defines the opening occupied by the transparent pane, and an outer edge 25 that is adjacent to the sash stile or rail. Thus, in an embodiment, the glass stop is cut to the appropriate length and then, depending upon the window for which the stop is to be used, a notch is cut at a predetermined position from a portion of the stop 22 that comprises the inner edge 23. A variety of apertures may be used for insertion of appropriately mated SDL bars. In one embodiment, the aperture is a triangular notch 24 excised from the body of the glass stop (e.g., FIG. 3). Alternatively, other types of apertures such as cylindrical apertures, slits, or rectangular notches may be used.

The glass stop may be notched prior to its inclusion in the window or door. Or, the stop may be notched after being assembled as part of the window or door panel.

Figure 4:
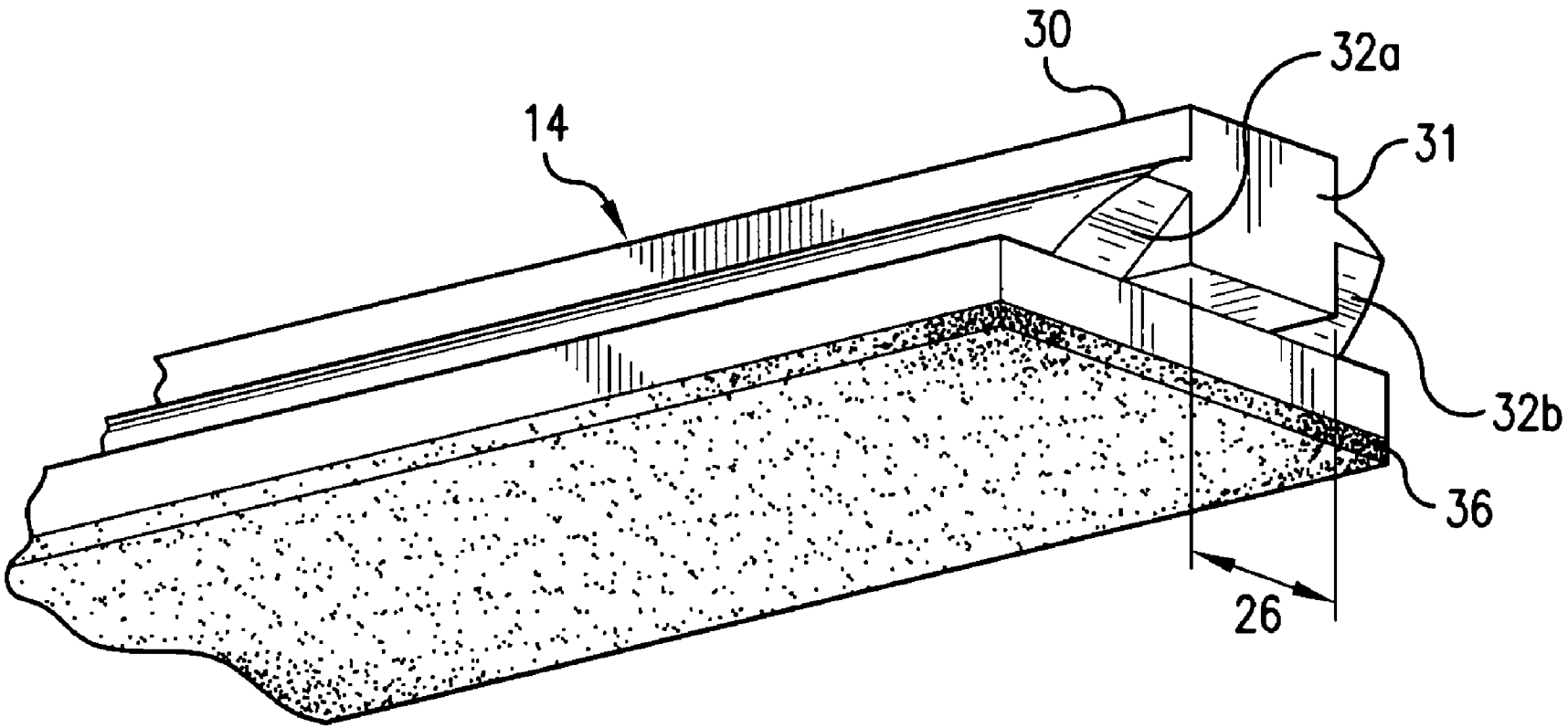
FIG. 4 shows a representation of a simulated divided light bar having a protrusion at the end for fitting into a notched window sash or door panel in accordance with an embodiment of the present invention.

FIG. 4 shows a representation of an embodiment of a SDL bar (e.g., muntin) having a protruding element 26 designed for insertion into a notched window sash or door panel at the end of the bar. As shown in the embodiment illustrated in FIG. 4, the SDL bar may be shaped so that when the bar is juxtaposed against a glass stop, the bar will be substantially flush with the glass stop, such that there is a minimal space between the stop and the SDL bar. As shown in the embodiment illustrated in FIG. 4, the SDL bar may comprise a substantially vertical surface at the end 31 of the bar that is perpendicular to the upper surface 30 of the bar. A triangular portion of the SDL bar may be cut out on both sides (32*a*, 32*b*) of the bar surface, thereby creating a protrusion 26, shaped like a right triangle, on the end of the SDL bar. Referring back to FIG. 2, it may be seen that the protrusion 26 on the SDL bar may fit neatly into the notch 24 created in the glass stop.

Figure 5:
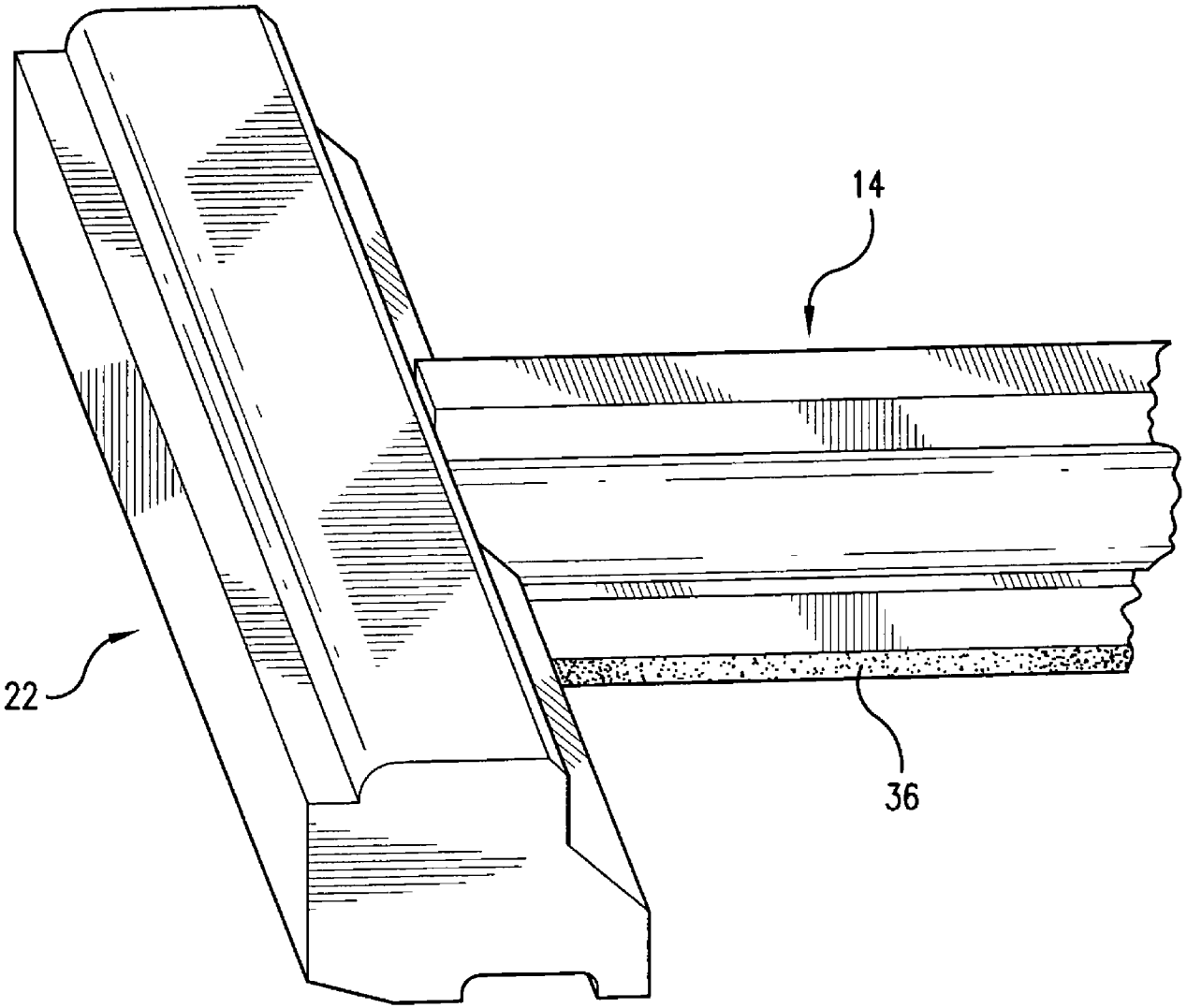
FIG. 5 shows a perspective top-front view of a simulated divided light bar having a protrusion inserted into a notch in the surrounding sash in accordance with an embodiment of the present invention.

FIG. 5 shows a perspective view of the upper surface of a SDL bar 14 having a protrusion inserted into a notch in a glass stop 22 of a window sash in accordance with an embodiment of the present invention. It can be seen that once assembled, the notch 24 on the glass stop and the protrusion 26 on the SDL bar are not apparent. In an embodiment, sticky tape or some other type of adhesive 36 may be used on the surface of the SDL bar that is to be positioned adjacent to the transparent portion of the panel (e.g. glass pane) to promote adhesion of the SDL bar to the transparent panel.

Figure 6:
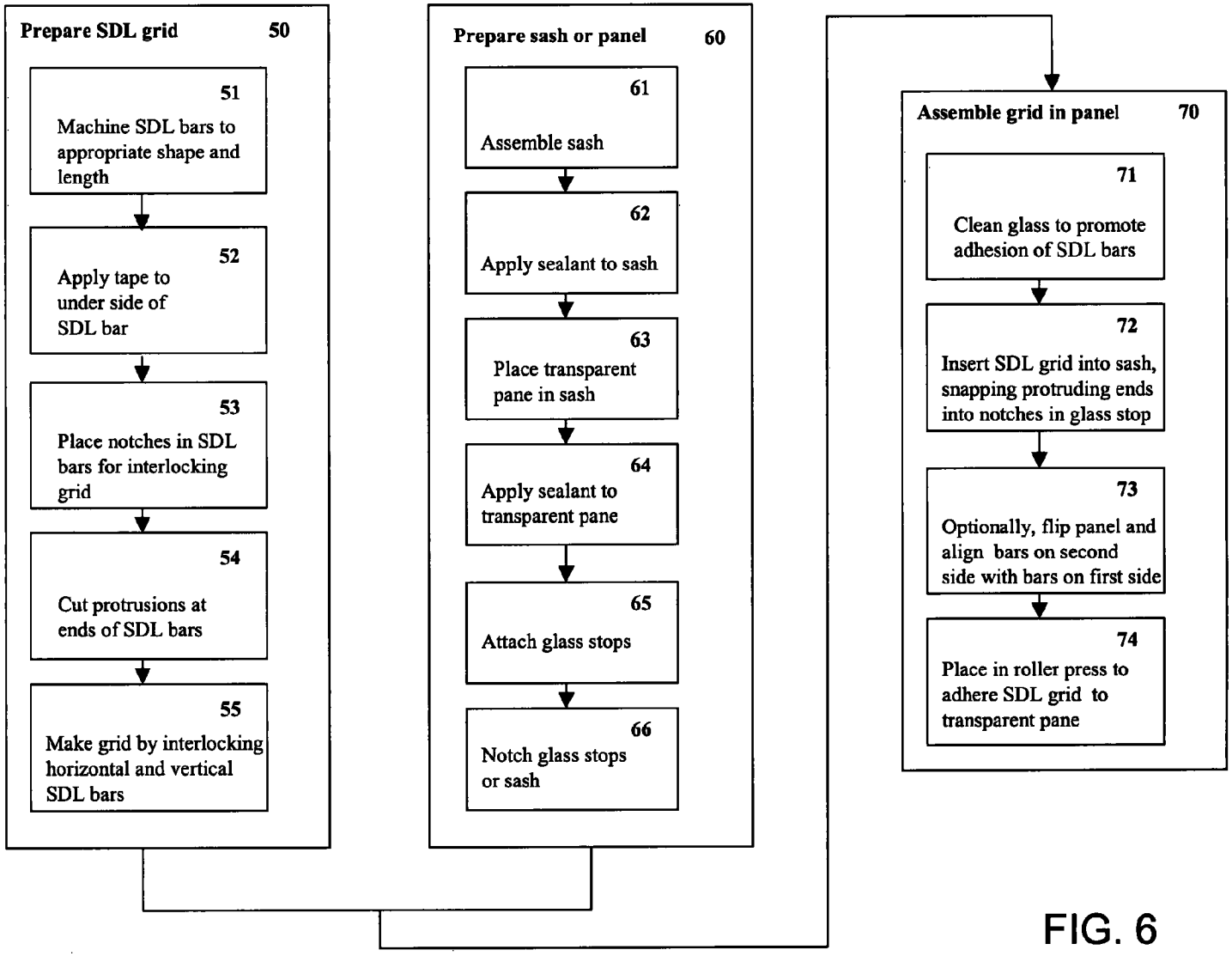
FIG. 6 shows a flow diagram of a process for assembly of a simulated divided light glass window or door in accordance with an embodiment of the present invention.

FIG. 6 shows a flow-chart representation of an embodiment of a process for making SDL products according to the present invention. As shown in FIG. 6, SDL (muntin) bars of the appropriate shaping (i.e., style), thickness, and length are prepared as required for the simulated divided light panel to be made 50. A series of SDL bars may be prepared, depending on the requirements of the production schedule 51. Once the bars have been fashioned, some type of adhesive, such as a double-sided sticky tape, may be adhered to the side of the bars that will be adjacent to the windowpane 52. Cutting and sizing the muntin bars may be done by manually cutting the muntin bars, or using an automated circular saw that is programmed to cut the bars to the appropriate length. Such programmable saws include, but are not limited to Joseph saws, a highly automated saw that may be used to notch and cut bars to length. As is known in the art, a JWE saw, a Pistorius saw, or a Phantom 2000 saw may also used; these types of saws vary from manual to semi-automatic.

Once the bars are trimmed to the appropriate length, notches may be cut into the bars 53, so that the bars may be assembled to form a grid. The notches may be any shape that allows for one bar to be fitted with another. Notches may be generally rectangular, triangular, or trapezoidal in shape, and may be positioned along the length of the bar. For example, to form a grid of two bars (one vertical and one horizontal) a notch may be cut in the center of each of the two bars, and the bars interlocked by fitting one notch into the other as is known in the art. For notching the bars, a Joseph saw, or a similar type saw may be used.

Once the bars have been notched at the appropriate position, protrusions having the appropriate shape to fit into the apertures that are to be placed in the glass stop, sash, or door panel, may be made at the end of the SDL bars 54. As described above, protrusions may be made on horizontal SDL bars, vertical SDL bars, or both. The appropriately shaped protrusions may be made by a variety of methods known by those of skill in the art. Preferably, the protrusion on the end of the SDL bar is a mirror image of the aperture (e.g., notch) cut out of the glass stop, window sash, or door panel. The protrusions may comprise a variety of shapes, such as expandable pins, cylinders comprising annular stops for insertion in a cylindrical aperture, and the like. In one embodiment, wooden SDL bars have the ends shaped as protruding triangular wedges.

Alternative protrusions may be used for vinyl or aluminum windows. For example, a button, screw or similar protrusion may be attached to the end of a vinyl or aluminum SDL bar. In this embodiment, the button may be shaped to snap or fit into an appropriately shaped aperture or well in the glass stop, window sash, or door panel. Also, a button, screw or similar protrusion may be attached to an aluminum SDL bar.

Many SDL windows and doors may be wood on one side (generally the interior face) and metal or vinyl on the other side (often the exterior face). In one embodiment, only the SDL bars used for the interior surface of the window are made with a protrusion for insertion into a notched window sash. Once the interior bars are in place, the window may be flipped over, and the SDL bars attached to the interior surface used to align the SDL bars being placed on the exterior surface. This method may be preferred where notching may compromise the structural integrity or appearance of an exterior sash or door panel, as for example, where the exterior sash or panel is made of vinyl or aluminum.

Once the individual SDL bars have been prepared, grids of interlocking SDL bars may be assembled and set aside for insertion into a window sash or door panel 55. As described above, to allow the bars to be assembled as grids, the bars may be notched along the length of the bar so as to allow two or more bars to be interlocked and positioned at right angles to each other. Grids of SDL bars may assembled without any type of adhesive or fastening to hold the grids together. In this way, the grids may be taken apart, and the relative positioning of the bars altered, as for example, by adjusting the shaping of the notch, or the position of a notch, if necessary. Alternatively, in some cases, the grids may be assembled using adhesive or fasteners to hold the grids together. In this way, grids assembled at one location may be secured for transport to a second location for use in simulated divided light products.

Also depicted in FIG. 6 is a method for assembly of a glass pane in a sash or door panel 60. As indicated in FIG. 6, assembly of the window in the sash or door panel 60 may be separate from assembly of the SDL grid 50. Thus, the sash or door panel may be made the at the same site as the is used of production of SDL products. Alternatively, the sash or door panel may be assembled at a different site than the site of production of SDL products.

Similar to the SDL bars, the parts of the sash (horizontal rails, vertical stiles, and optionally, glass stops) may be cut to size manually, or using an automated circular saw 61. In an embodiment, the parts of the sash or door panel are cut to size using Pistorius or Sampson double miter saws. Or, a Dewalt chop saw and Tiger saw may be used.

Next, the sash may be assembled. The window sash may be prepared using two vertically positioned stiles and two horizontal rails. Once aligned, the rails and stiles may be fastened at their corners using staples, nails, pins, screws, or other types of fasteners. Also, tape, glue, or other types of adhesives may be used to assemble the stiles and rails.

At this point, the sash may be glazed with a sealant and bonding agent to help secure the glass panel in the sash 62. In one embodiment, Dow Corning Silicone 1199 may be used. Alternatively other known sealant type materials, such as a caulking material, or a two part epoxy, may be used. Application of the sealant may be automated. For example, the pre-assembled sash may be placed in a robotic applicator, such as is commercially available from Wegoma, Inc., or Besten, Inc., that glazes the inside surface of the rails and stiles of the sash.

The transparent panel comprising the window may then be placed in the sash and positioned such that each edge of the pane abuts an inner surface of each of the two rails and each of two stiles 63. As is known in the art, the panel may be made of glass. Or, other types of transparent panels such as Plexiglas or other types of plastic may be used.

If a glass stop is to be used, a bonding agent or sealant (e.g., silicone) may then be applied 64 to the outer edge of one surface of the transparent pane, e.g., the portion of the glass adjacent to the sash, for application of the glass stop. The sealant applied at this step may be the same as, or distinct from, the sealant used to secure the transparent pane in the sash or door panel.

Next, the glass stop may be applied 65. The glass stop may be applied around the perimeter of the glass and flush to the sash or door panel. The glass stop may be shaped as relatively thin strips that fit adjacent to the sash or door panel. The glass stop may be made of the same material used for the stiles and rails. The stops may be patted into place (e.g., using a soft mallet) such that the sealant/bonding agent applied to the surface of the glass pane holds the glass stops adjacent to the glass surface and the surrounding sash or door panel. Also, in one embodiment, the glass stop may be attached to the sash using fasteners such as nails, pins, and the like.

At this point, the glass stop, sash, or door panel is ready for notching 66. In one embodiment, the system is automated such that as the sash comes out of the nailing machine used to attach the glass stop, the sash may be fed directly into the notching apparatus. Thus, the notching apparatus may comprise a horizontal in-feed that is directly abutted to the out-feed of the machine used to nail the glass stop to the sash.

As described in more detail below, notching may comprise an interactive apparatus that adjusts placement of the notches based upon the expected production schedule, as well as the actual sash that is being processed by the notching apparatus. In one embodiment, positioning of the notches in the sash or door panel is adjusted on-line. For example, the notching apparatus may include a computer program and related software that allows the notching apparatus to determine, based on the production schedule, whether the sash is going to be used for a simulated divided light panel. If the sash is to be used for a SDL panel, the sash may then be notched at the appropriate positions based on the type of SDL panel being made. Conversely, if the window or door is not a SDL product, but is to be completely transparent, the sash may pass through the notching apparatus without any type of notching. As used herein, a computer program comprises a computer-encoded language that encodes the steps required for the computer to perform a specific task or tasks. Also, as used herein, software comprises the computer program(s) used in conjunction with any other operating systems required for computer function.

For example, in some cases, the actual light opening of the sash (i.e., the internal transparent volume within the sash) may be slightly larger or smaller than the expected opening, as for example due to slight inaccuracies in the placement of the sash components. Thus, there may be a need to adjust the placement of the notches in any one sash or door panel to accommodate the appropriate SDL grid, so as to have symmetrical light openings throughout the sash or door panel once the grid is applied. Thus, the notching apparatus may compare the theoretical size of the sash or door panel to the actual measured size, and adjust the position of the notches in the panel either up or down on the Y axis (along the height of the window or door), and/or left or right along the X axis (along the width of the window or door), to improve the appearance of the sash or panel. There may be a threshold of variance above which the window sash or door panel cannot be used as an SDL panel. There may also be a lower limit of variance below which no adjustment in the notching of the panel needs to be made. For example, in one embodiments, if the variance is less than 1/16 of an inch for a standard window or door, the notching apparatus may not require an adjustment to be made. Or, in alternate embodiments, the apparatus may be programmed such that if the variance is less than 1/32 of an inch, or 1/64 of an inch, for a standard window or door, the notching machine may not require an adjustment.

As described in more detail below, the sash opening may be scanned using a laser to determine the actual size of the opening versus theoretical size. If an adjustment in the positioning of the notch is required, a servo driven motor and ball screw(s) may be used to move the notching tool(s) to the appropriate notch location. Additionally or alternatively, other types of measuring systems such as, but not limited to, encoders, lineal transducers, and lineal timing belt petitioners, may be used to position the notches appropriately.

Once the sash has been notched and the SDL grid has been assembled, the grid may be emplaced within the sash or door panel 70. The glass pane may be cleaned with a solvent such as silane, or a similar cleaner, to promote attachment of the adhesive on the underside of the SDL bar to the transparent panel 71. The type of cleaner may be varied to be compatible with the surface to which the SDL grid is applied, but generally, is used to remove any dust or dirt from the transparent panel in the region of the panel to which the grid is applied. For example, while silane may be used to clean glass, an aqueous-based cleaner may be used to clean a plastic panel. If the grid includes tape to facilitate adhesion of the grid to the transparent panel, the tape backing may be removed at this point. The grid is then aligned with the notches in the sash. Next, the grid may be positioned on the panel by placing the protruding ends of the grid into the notches in the glass stop 72.

In some cases the window may have a SDL grid on only one side of the window or door. In other cases, however, SDL grids are positioned on both the interior and the exterior surface of the window. Thus, in one embodiment, the notches may be made on both sides of the panel for placement of a second SDL grid. Notching both surfaces may entail removing the door panel or sash from the notching apparatus, flipping the panel over, and feeding the panel or sash into the notching apparatus so that the side of the panel that has not been notched may be processed.

Alternatively, where SDL bars are applied to both sides of the transparent panel, the glass may be turned over to expose the plain glass face, and the grid on the interior surface of the glass may be used to align the grid on the exterior surface of the glass. This method may be preferred since it does not require notching both sides of the sash or door panel 73.

At this point, the sash or door panel having the SDL grid in place on one or both surfaces of the transparent panel may be inserted into a roller press 74. The roller press may gently presses the grid to the surface of the transparent panel, thereby allowing the adhesive on the surface of the SDL bars to attach the grid onto the surface of the transparent panel. Alternatively, where SDL bars are attached to both surfaces, the first SDL grid may be secured by the rollers prior to application of the second grid.

Figure 7A:
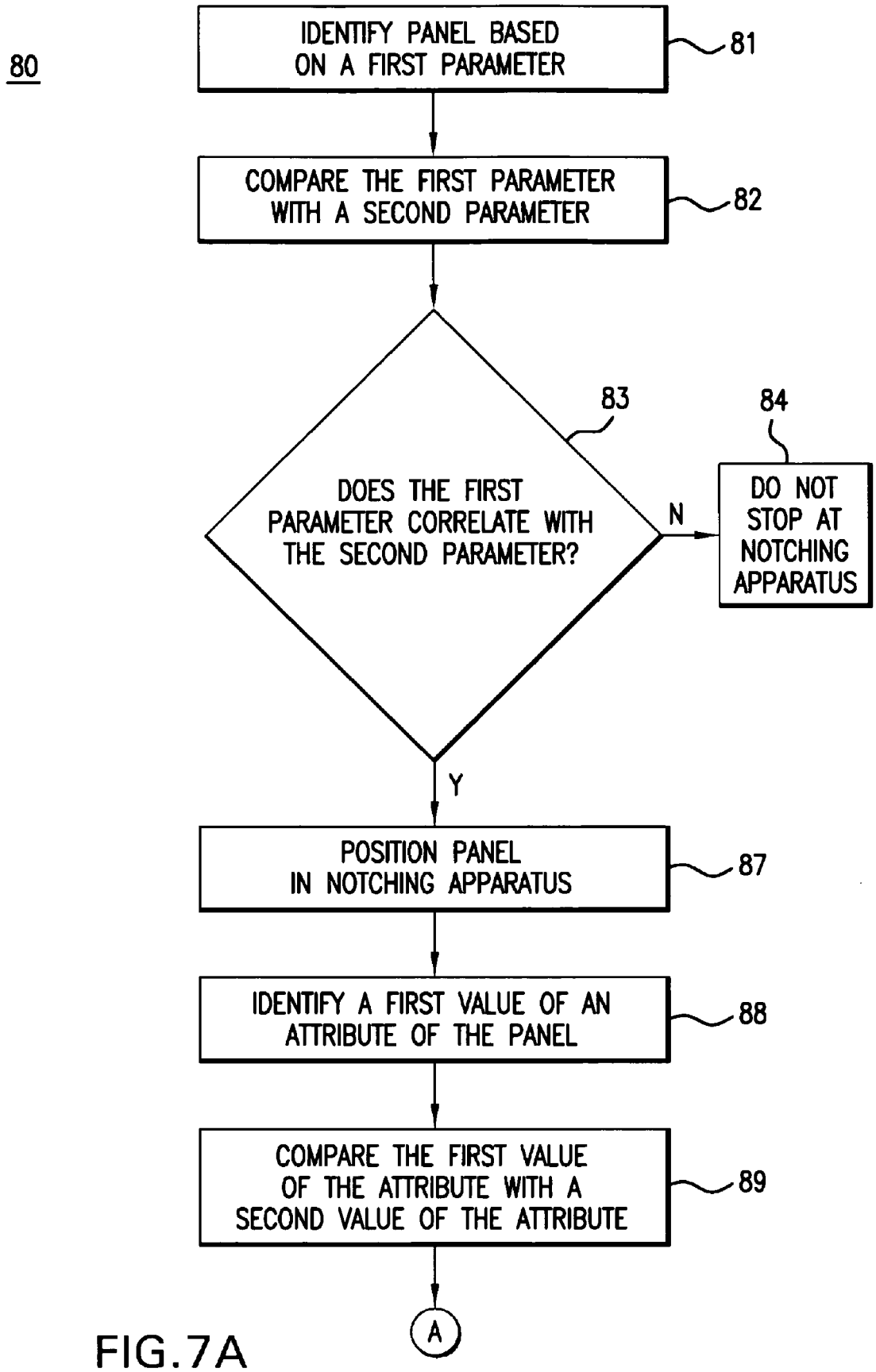
FIGS. 7A and 7B show a flow diagram of a process for notching a simulated divided light panel in accordance with an embodiment of the present invention.
Figure 7B:
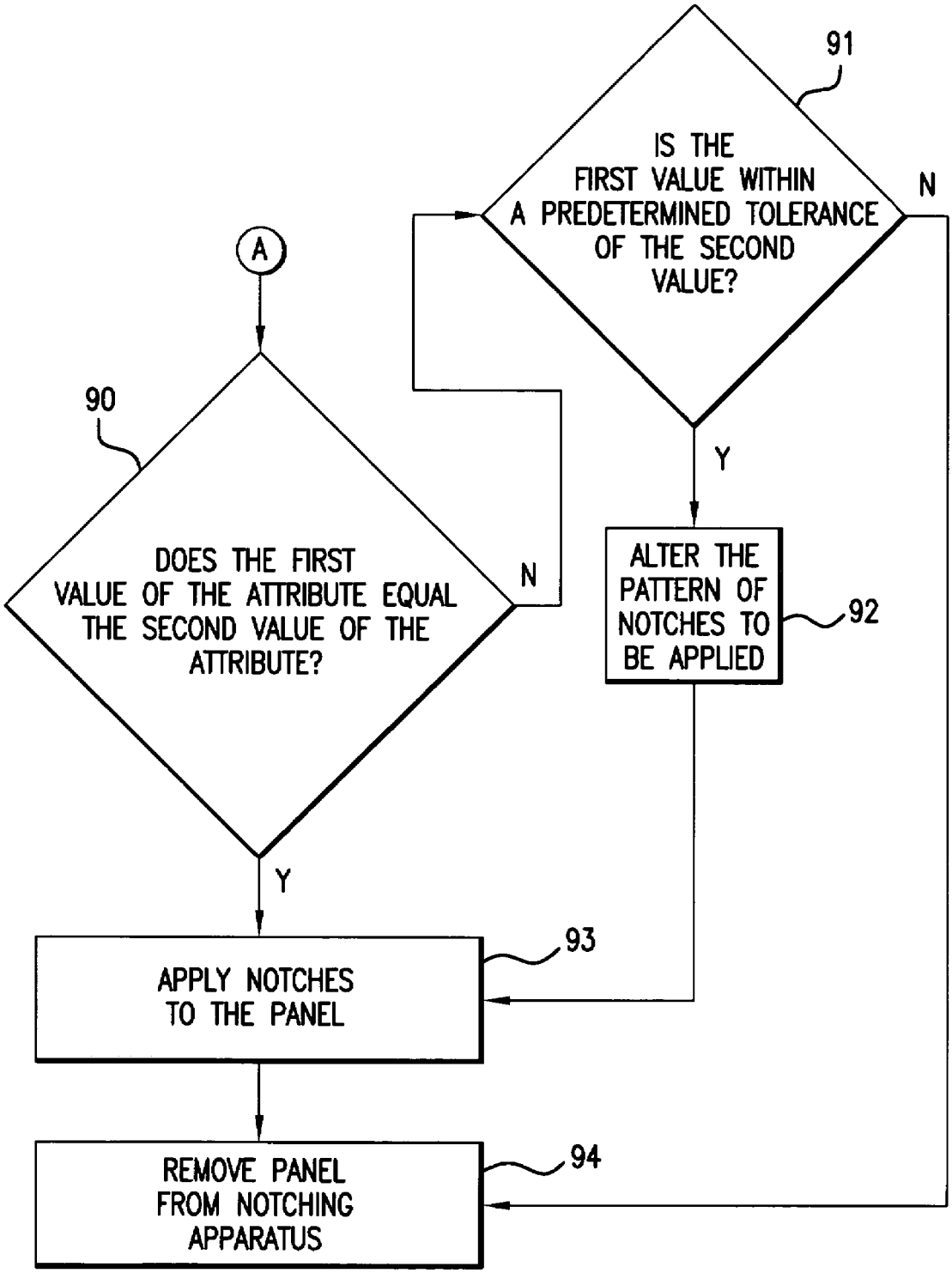

Referring now to FIGS. 7A and 7B, a method 80 according to an embodiment of the present invention is shown. The method 80 may be used to make a window or door having a simulated divided light as described herein. Alternatively, the method may be used for other suitable products.

As indicated by block 81, the method 80 may comprise identifying a first panel based at least in part on a first parameter. The first panel may be identified as a panel on which an SDL assembly, e.g., a grid or grille of interlocking muntin bars, will be applied.

In one embodiment, the first parameter may comprise an actual position of the first panel relative to a plurality of panels in a production line. The production line may be a mixed production line, i.e., a production line in which only a select number of panels will have an SDL assembly applied. For example, the first parameter may indicate that every fifth panel may have an SDL assembly applied to it.

Other suitable parameters may be used. For example, the first parameter may comprise a profile of the panel. In this example, an SDL assembly may be applied only to panels having certain, predetermined profiles. A panel that does not have one of the predetermined profiles will not have notches applied to it.

The first panel may be identified by a sensor. The sensor may comprise a counter identifying or detecting the passage of panels. The sensor may comprise a camera, which may be used to image the panels or reference marks (such as for example, bar codes or other identifying marks) located on the panels. The camera may comprise a detector, which may be a Charge Coupled Device (CCD) array, or a Complementary Metal Oxide Semiconductor (CMOS) detector array. The camera may also comprise a circuit, control electronics, and an angled light source.

Other suitable sensors may be used. For example, the sensor may comprise an emitter adapted to emit a collimated light beam and a receiver adapted to detect the emitted light. When a panel passes through the light beam, a photo-sensor detects a change (e.g., interruption) in the light beam and sends a signal to a controller. The light emitted may be in the infrared spectrum. In another embodiment, the light may be a laser beam.

Alternatively, other suitable means of identifying the panel may be used. For example, Radio Frequency Identification (RFID) may be used. RFID may use radio waves to identify individual panels. As is known in the art, an RFID system may comprise a tag, which generally comprises a microchip with an antenna, and an interrogator or reader with an antenna. The reader may transmit electromagnetic waves. The tag antenna may be tuned to receive these waves. A passive RFID tag may draw power from a field created by the reader. The chip may modulate the waves that the tag sends back to the reader, which converts the new waves to digital data.

In one embodiment, the method 80 may comprise determining whether an assembly, such as a grid of SDL bars, will be applied to the first panel. As indicated by block 82, determining whether an assembly will be applied to the first panel may comprise comparing the first parameter with a second parameter. The assembly may be applied to the first panel if the first parameter correlates with the second parameter. The second parameter may comprise a scheduled position (e.g., as opposed to an actual position which may comprise the first parameter) of the first panel in the production line.

The scheduled position of the panel may be stored by a processor. For example, the schedule may indicate that a panel having a particular position in a production line should have an SDL assembly applied to it. In one such example, every fifth panel should have an SDL assembly applied to it. Other suitable predefined positions may be used to identify which panel should have an SDL assembly applied to it. In an alternate embodiment, the second parameter may comprise a particular, pre-defined panel profile, which should have an SDL assembly applied to it. A panel not having the predefined profile would not be selected for having an SDL assembly applied to it. Thus, notches would not be applied to such a panel.

As indicated by decision diamond 83, if the first parameter does not correlate with the second parameter, the panel does not stop at a notching apparatus 84. Instead, such a panel may continue traveling further along the production line. For example, if the actual position of the panel in the production line does not correlate with its scheduled position, the panel will not stop at the notching apparatus. Alternatively, if the profile of the panel, as indicated by the first parameter, does not correlate with a stored profile (i.e., the second parameter), the panel will not stop at the notching apparatus. Such a panel is not one on which an SDL assembly will be applied, and thus will continue traveling further along the production line.

As indicated by block 87, if the first parameter correlates with the second parameter, the panel is positioned in the notching apparatus. As described in further detail below, the notching apparatus applies notches to the panel to accommodate the SDL assembly on the panel.

In one embodiment, the method 80 may comprise verifying that the assembly will be applied to the first panel. Each panel may comprise an attribute, such as, for example, a dimension of the panel. Other suitable attributes may be used. As indicated by block 88, the method 80 may comprise identifying a first value of the attribute of the panel. For example, a width of the first panel positioned in the notching apparatus may be measured. The first value may be based at least in part on a measurement of the attribute. The first value of the attribute of the first panel may be communicated to a processor.

As indicated by block 89, the method 80 may comprise comparing the first value of the attribute with a second value of the attribute. The second value of the attribute may comprise a standard value for the attribute. For example, the second value may comprise a numerical value for a designed width of the first panel. The second value may be stored by a processor. The processor may compare the first and second values.

As indicated by decision diamond 90 (FIG. 7A), if the first value of the attribute equals the second value of the attribute, notches are applied to the panel (as indicated by block 93). If the first value of the attribute equals the second value of the attribute, one may reasonably conclude that the first panel positioned in the notching apparatus corresponds with the first panel in the schedule. Thus, the correct SDL assembly will be applied to the correct panel among the plurality of panels in the production line.

If the first value of the attribute does not equal the second value of the attribute, another comparison is made. As indicated by decision diamond 91, it may be determined whether the first value of the attribute is within a predetermined tolerance of the second value of the attribute. If the first value of the attribute is outside the predetermined tolerance of the second value of the attribute, the first panel may be removed from the notching apparatus, as indicated by block 94. A value outside the tolerance may indicate a production defect or that the panel in the notching apparatus does not correspond to the production schedule. For example, there may be an error in the schedule. Also, the panels in the production line may be out of order.

If the first value of the attribute is within the predetermined tolerance of the second value, the pattern of notches to be applied to the first panel may be altered. For example, the pattern itself may be altered or adjusted. Alternatively, a placement or positioning of the notches to be applied to the first panel may be adjusted. Thus, the pattern or placement of notches may be altered based at least in part on the first value, e.g., a measured value, of the attribute. The method 80 may vary the placement of SDL assemblies to accommodate manufacturing tolerances of panels.

The method 80 may comprise forming a pattern of notches in a sash of the first panel corresponding with a configuration of an SDL assembly. As described herein, the notches may be adapted to accept portions of the assembly. As indicated by block 93, the notches are applied to the panel. The pattern of notches may be punched by the notching apparatus in the sash of the first panel. As indicated by block 94, the panel may then be removed from the notching apparatus.

The processes of the invention may be used to make a variety of SDL products. For example, in one embodiment, the portion of the panel having the notch(s) may comprise a window sash, such that when the bar is emplaced, the window may comprise a simulated divided light window. Or, the portion of the panel having the notch(s) may comprise a glass stop positioned adjacent to a window sash, such that when the bar is emplaced, the window may comprise a simulated divided light window. In another embodiment, the portion of the panel having the notch(s) may comprise a door panel such that when the grid is emplaced, the door may comprise a simulated divided light door. Or, the portion of the panel having the notch(s) may comprise a glass stop positioned adjacent to a door panel, such that when the bar is emplaced, the window may comprise a simulated divided light door.

Figure 8:
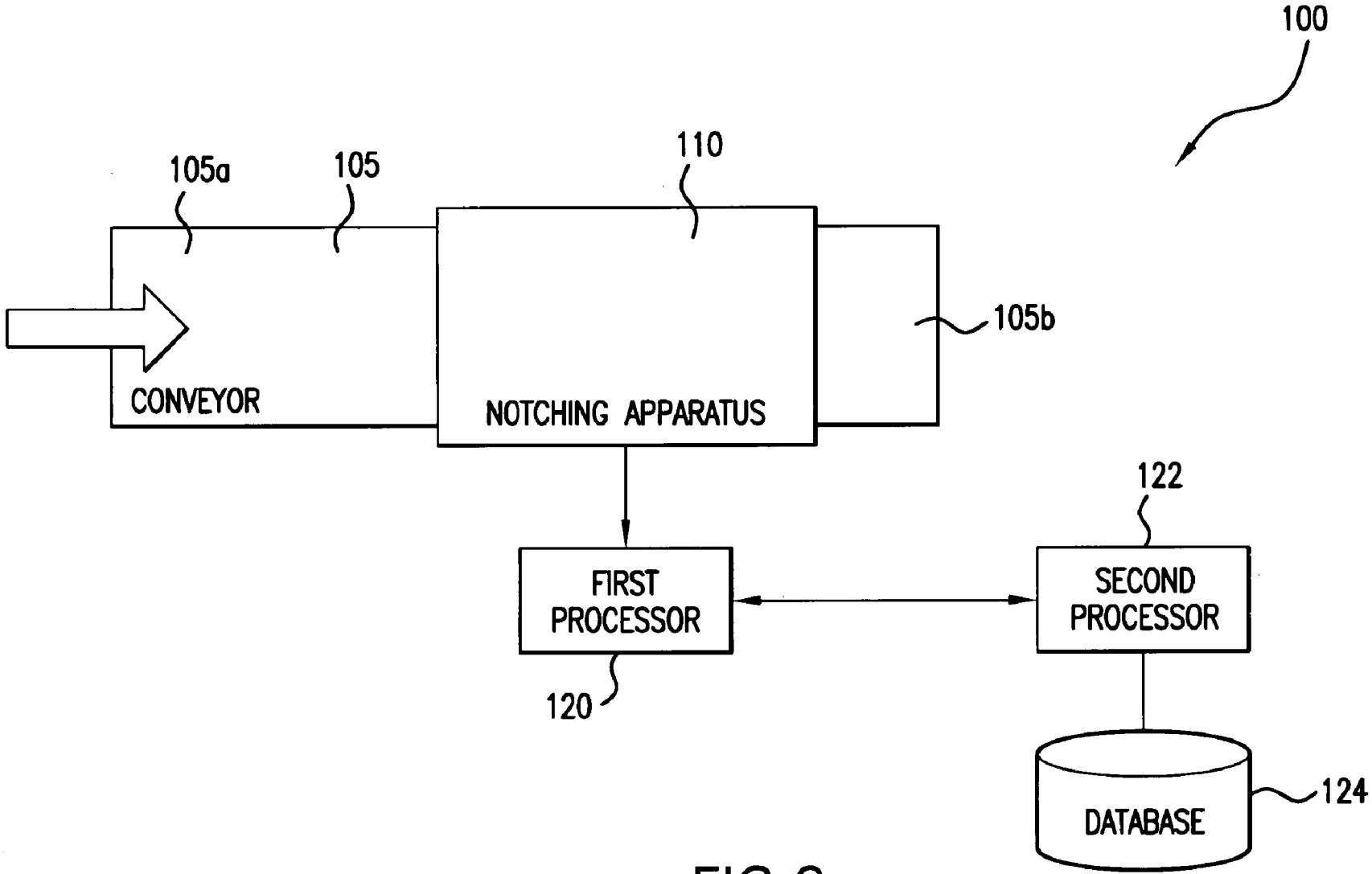
FIG. 8 shows a schematic representation of a system for notching a simulated divided light panel in accordance with an embodiment of the present invention.

Referring now to FIG. 8, a schematic of a system 100 according to an embodiment of the present invention is shown. The method 80 described above may be practiced on the system 100. The system 100 may comprise a notching apparatus 110. The notching apparatus 110 may be adapted to form a pattern of notches in a sash of a first panel (not shown) of a plurality of panels. The pattern of notches may correspond to a configuration of an assembly of SDL bars. The SDL bars may form an interlocking grid or grille on the first panel. Alternatively, the system may be used for other suitable applications.

Figure 9:
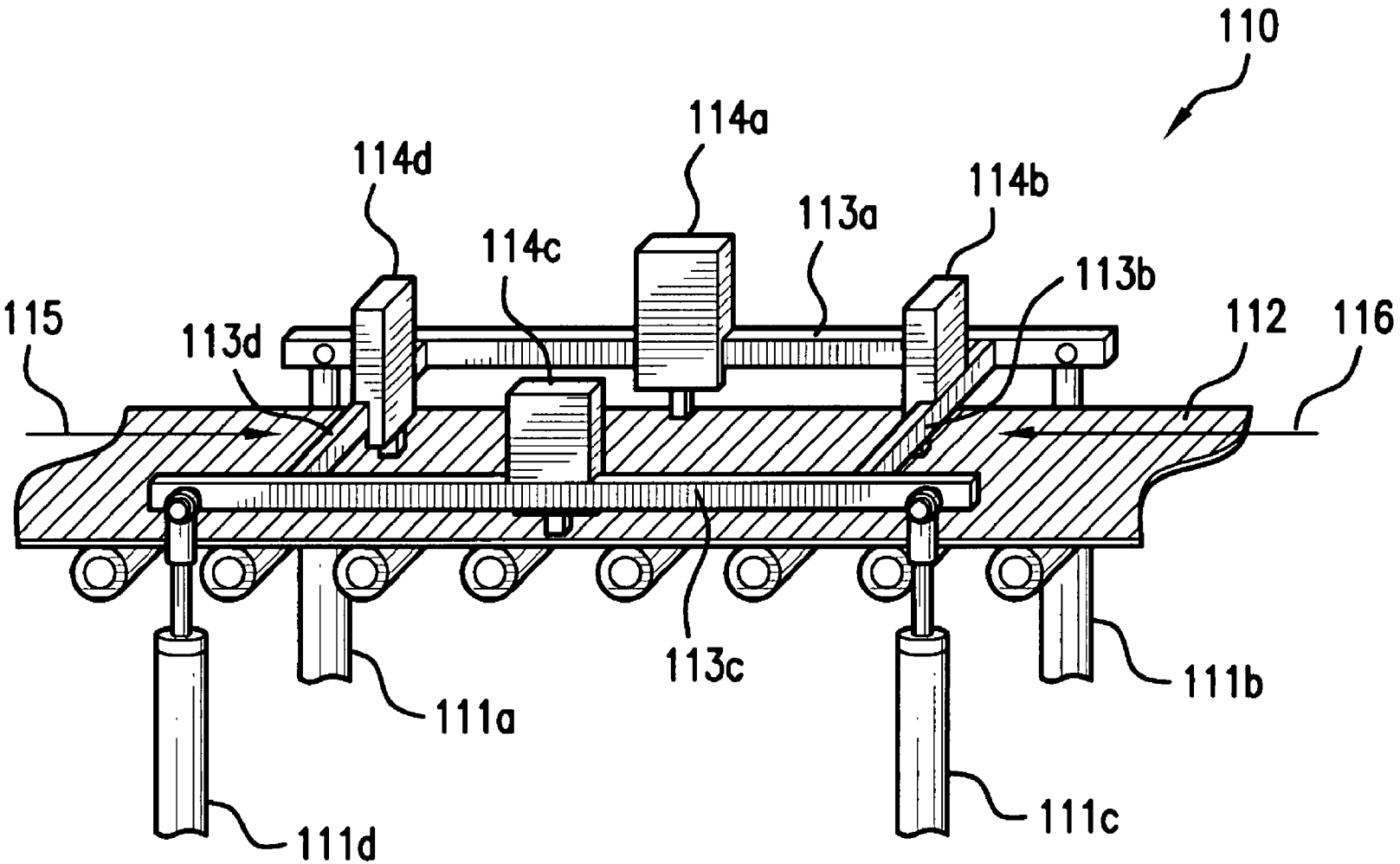
FIG. 9 shows a schematic representation of an apparatus for notching a simulated divided light panel in accordance with an embodiment of the present invention.

Referring now to FIG. 9, the notching apparatus 110 is shown. The notching apparatus 110 may be used in systems other than the system 100. The notching apparatus 110 may comprise a plurality of supports 111*a-d*. The plurality of supports 111*a-d* may be adapted to support a platform 112. The supports 111*a-d* may be adapted to adjust the height or inclination or the platform 112 to accommodate different production lines or arrangements.

The platform 112 may be adapted to support and manipulate (e.g., move, change the position of, secure or clamp, etc.) the first panel. The supports 111*a-d* also support a plurality of guide rails 113*a-d*. The guide rails 113*a-d* may be formed of structural steel and may be adapted to support and form a pathway on which a plurality of punches 114*a-d* may travel. The punches 114*a-d* may also be adapted to make fine adjustments without traveling along guide rails 113*a-d*. Guide rails 113*b* and 113*d* may be adapted to travel along guide rails 113*a* and 113*c* in the direction shown of arrows 115 and 116. Although not shown, guide rails 113*a* and 113*c* may be adapted to travel in a direction perpendicular to the direction shown by arrows 115 and 116.

The punches 114*a-d* may comprise a sharpened tool, such as a chisel-like tool. Each of the punches 114*a-d* may be adapted to be driven into the grille locations to form notches at an appropriate depth in the panels. Other tools may be used, such as drills, lasers, and other suitable cutting, stamping, or punching tools.

Referring again to FIG. 8, the notching apparatus may be coupled with a conveyor 105. The conveyor 105 may comprise a first end 105*a* and a second end 105*b* disposed opposite the first end 105*a*. Although shown as a single conveyor, the conveyor 105 may comprise a plurality of conveyors. The arrow in FIG. 8 shows the general direction of travel of the conveyor 105, i.e., from the first end 105*a* toward the second end 105*b*. The conveyor 105 may be adapted to transport the panels to and away from the notching apparatus 110.

In one embodiment, the system 100 may comprise a first processor 120. The first processor 120 may be disposed in operative communication with the notching apparatus 110. The terms "communicate" or "communication" mean to mechanically, electrically, optically, or otherwise contact, couple, or connect by either direct, indirect, or operational means.

The first processor 120 may comprise a Programmable Logic Controller (PLC) (not shown) and a local processor (not shown). The PLC and the local processor may be disposed in operative communication with one another. The PLC may be adapted to output control signals to control the notching apparatus 110. The local processor may comprise a touch screen (not shown) and may be adapted to serve as an interface with a human operator of the notching apparatus 110.

A second processor 122 may be disposed in operative communication with the first processor 120. In one embodiment, the second processor 122 may be disposed in operative communication with the notching apparatus 110. The second processor 122 may be adapted to control the first processor 120. In one embodiment, the first processor 120 may be adapted to control the second processor 122.

The first processor 120 and the second processor 122 may comprise a computer-readable medium, such as a random access memory (RAM) (not shown) coupled to a processor (not shown). The first and second processors 120, 122 may execute computer-executable program instructions stored in memory (not shown). Such processors may comprise a microprocessor, an ASIC, and state machines. Such processors comprise, or may be in communication with, media, for example computer-readable media, which stores instructions that, when executed by the processor, cause the processor to perform the processes described herein.

Embodiments of computer-readable media include, but are not limited to, an electronic, optical, magnetic, or other storage or transmission device capable of providing a processor with computer-readable instructions. Other examples of suitable media include, but are not limited to, a floppy disk, CD-ROM, DVD, magnetic disk, memory chip, ROM, RAM, an ASIC, a configured processor, all optical media, all magnetic tape or other magnetic media, or any other medium from which a computer processor can read instructions.

Also, various other forms of computer-readable media may transmit or carry instructions to a computer, including a router, private or public network, or other transmission device or channel, both wired and wireless. The instructions may comprise code from any suitable computer-programming language, including, for example, C, C++, C#, Visual Basic, Java, Python, Perl, and JavaScript.

The first and second processors 120, 122 may operate on any operating system capable of supporting a browser or browser-enabled application, such as Microsoft® Windows® or Linux. Such a processor includes, for example, personal computers executing a browser application program such as Microsoft Corporation's Internet Explorer™, Netscape Communication Corporation's Netscape Navigator™, and Apple Computer, Inc.'s Safari™.

The second processor 122 may be adapted to communicate to the first processor 120 a first parameter of the first panel. As described above with reference to the method 80, the first parameter may comprise an actual position of the first panel relative to the plurality of panels in a production line. Also as described above, other suitable parameters may be used, such as a profile of the panel.

The system 100 may comprise a first sensor (not shown) adapted to identify the first panel based at least in part on the first parameter of the first panel. The first sensor may be similar to that described above with reference to the method 80. Alternatively, other suitable sensors may be used. The first sensor may be coupled with or disposed in communication with the notching apparatus 110. Alternatively, the first sensor may be disposed upstream of the notching apparatus 110, such as for example along the first end 105*a* of the conveyor 105. In one embodiment, the first sensor may be disposed in communication with the first processor. The first sensor may communicate the first parameter of the first panel to the first processor 120.

The second processor 122 may be adapted to compare the first parameter with a second parameter. As described above, the second parameter may comprise a scheduled position of the first panel in the production line. The second parameter may be stored in a database 124. The second processor 122 may be adapted to retrieve data from the database 124 for processing.

The system 100 may comprise a second sensor (not shown). In one embodiment, the second sensor may comprise a plurality of sensors. The second sensor may be in operative communication with the first processor 120. The second sensor may be adapted to identify a first value of an attribute of the first panel. As described above with reference to the method 80, the attribute may comprise a dimension of the panel. For example, the second sensor may measure a dimension of an opening of the sash between the vertical and horizontal glass stops, i.e., a width opening and a height opening.

The second processor 122 may be adapted to compare the first value of the attribute of the panel with a second value of the attribute of the panel. The second value of the attribute may be stored in the database 124. As described above, the first value may be based in part on a measurement of the attribute. For example, the first value of the attribute may be the actual width of the horizontal glass stop measured by the second sensor. Also as described above, the second value may comprise a standard or designed dimension of the attribute.

If the first value of the attribute equals the second value of the attribute, the second processor 122 may communicate a signal to the first processor 120 to actuate the punches 114*a-d* to notch the first panel. Having been notched, the first panel may be removed from the notching assembly 110.

The first processor 120 may be adapted to alter the pattern of notches formed in the first panel by the notching apparatus based at least in part on the first value of the attribute. If the first value of the attribute does not equal the second value of the attribute, the second processor 122 may determine whether the first value is within a predetermined tolerance of the second value of the attribute. Such tolerances may be stored in the database 124, and retrieved by the second processor 122. If the first value of the attribute is within the predetermined tolerance of the second value, the pattern of notches may be altered or adjusted. The first processor 120 may communicate a signal to the punches 114*a-d* to reposition along the guide rails 113*a-d* to account for the actual measurement represented by the second value. The punches 114*a-d* may then be actuated to form the pattern of notches in the first panel.

If the first value of the attribute is outside the predetermined tolerance of the second value of the attribute, the first processor 120 may communicate a signal to the notching apparatus 110 and/or the conveyor 105 to remove the first panel from the notching apparatus 110.

Figure 10:
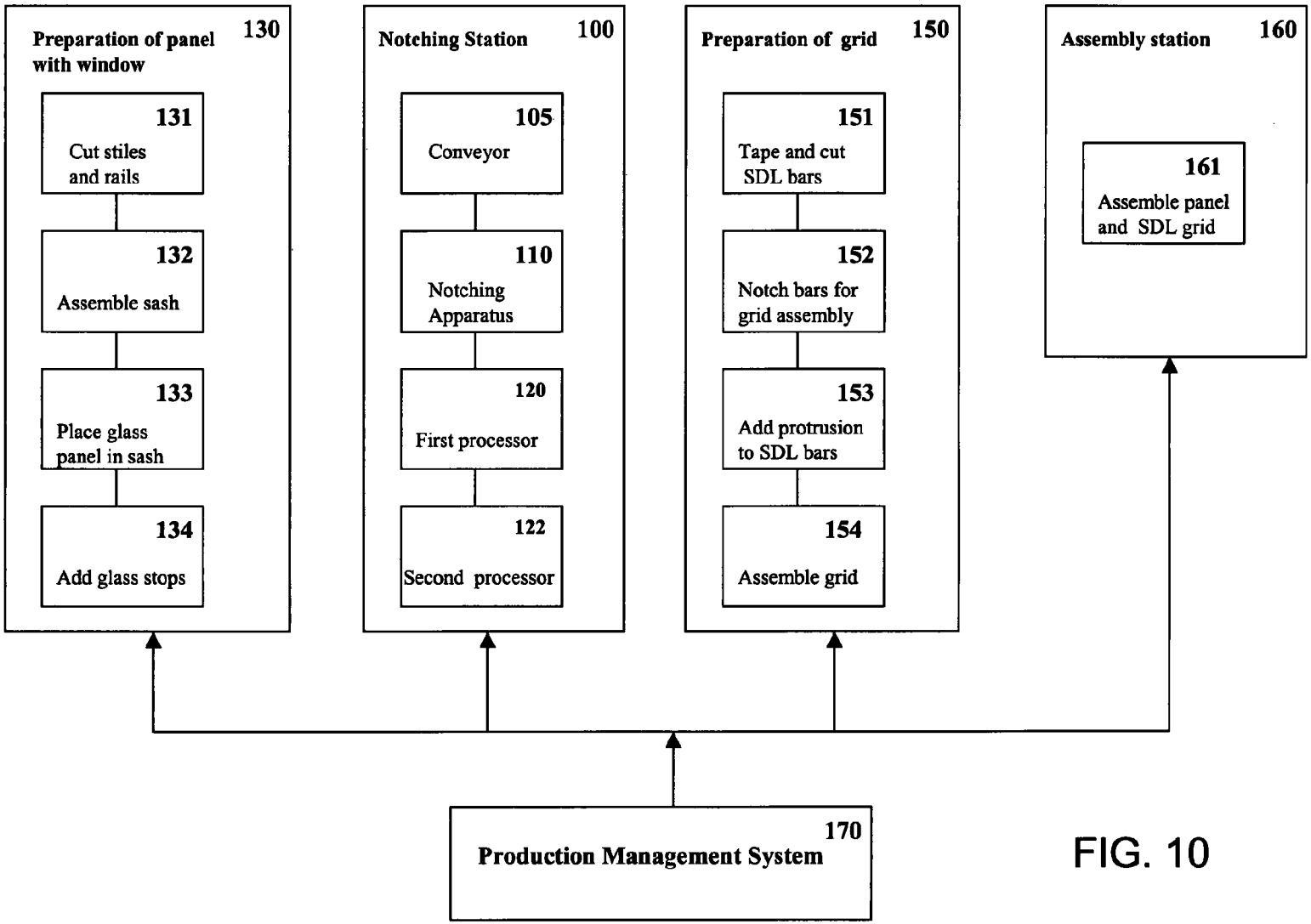
FIG. 10 shows a schematic representation of a system for assembly of a simulated divided light glass window or door in accordance with an embodiment of the present invention.

A system for preparing windows using processes and systems of the present invention is depicted schematically in FIG. 10. Because of the precision associated with placement of SDL bars using the processes of the present invention, the entire system may be automated. In an embodiment, the system may comprise a station for preparation of the window or door panel 130. The station for preparation of the window or door panel may comprise a device for automated cutting of the stiles, rails and glass stops 131. Next, the sash or door panel may be assembled 132 and transferred to an assembly table where a pane comprising a transparent material may be placed in the sash 133. The assembled window sash and or door panel may then be transferred to a station where the glass stops are positioned in the window and or door 134. Each of the substations (131, 132, 133, and 134), may be completely automated using robotics. Alternatively, each station may employ a human worker, or there may a human worker overseeing at least some of the stations.

The assembled sash may then fed to the system for notching 100. As described herein, the notching system 100 may comprise a notching apparatus 110 that notches the sash at the appropriate position. The notching system may also include a conveyor 105 that feeds assembled panels into the notching apparatus 110. As discussed in more detail herein, the notching apparatus may be controlled by processors 120 and 122 that assesses the product being made in relation to the production schedule, and determines whether the panel is to be notched at all, and if so, where the panel is to be notched.

The system may also comprise a station for manufacture of the SDL grid 150. The station for preparation of the SDL grid may comprise a station for cutting and taping of the horizontal SDL bars and the vertical SDL bars based on the SDL product to be produced 151. The SDL bars may then sent to a station where the bars may be notched along their length such that vertical and horizontal SDL bars can be joined by interlocking of the notched portions to form a grid 152. Next, SDL bars of the appropriate length may be sent to a station 153 to be shaped or trimmed to provide protrusions, such as the wedge-shaped protrusion shown in FIG. 4. Once SDL bars of the appropriate size are notched and the protruding ends are made, the grid may be assembled 154. Similar to the station for manufacture of the sash or door panel 130, the station for manufacture of SDL bars 150 may comprise substations (151, 152, 153, and 154) that are at least in part automated using robotics. Or, each station may employ a human worker, or there may a human worker overseeing at least some of the stations.

At this point, the assembled sash or door and SDL grid may be sent to a station for assembly of the grid and panel into the SDL product 160. At the assembly station, the SDL grid may be snapped into place in the appropriate notched sash or door panel 161. In contrast to systems used in the past, which require extensive manipulation and cross-checking of the positioning of the SDL grid within the sash or door panel, the system of the present invention may allow the grid to be inserted into the sash or door panel place in a single step.

As illustrated in FIG. 10, the entire system may be under the control of a second system that is used to manage production 170. Or, only a subset of the stations in the system for the manufacture of SDL product may be under control of the production management system. The production management system may comprise a computerized system that is used to coordinate and manage the intake of orders with the amount and type of products produced. For example, on one embodiment, the notching system 100 is under control of the production management system. Thus, in one embodiment, the second processor 122 may be in direct communication with, or part of, the production management system 170. Also, the database 124 may be in communication with, or part of, the production management system 170.

EXAMPLES

The present invention may be better understood by reference to the following non-limiting examples.

Example 1

Preparation of Interlocking Muntin Bars

As a first step, the bars that will become either the horizontal or vertical portions of the SDL grid may be cut. Generally, SDL doors and windows may be required in a large variety of sizes, thus necessitating bars of different length. Once the bars have been cut, they may be measured to confirm accuracy of the sizing.

Next, double-sided sticky tape (e.g., 3M, VHB tape) or some other adhesive is applied to the side of the bar that will be adjacent to the transparent panel. In this procedure, the bar is again measured and tape applied along the length of the bar. Where tape is used as the adhesive, the backing may be left on the exposed side of the tape to protect the adhesive until the bar is applied to the glass.

Once the adhesive tape has been applied, the bars may then be trimmed at one end and then further trimmed to the required length using a programmable circular saw that allows the length of the bars to be assessed to within 0.015 inch. The Joseph saw is a highly automated saw that notches and cuts bars to length. A JWE saw and a Pistorius saw may also be used; these saws may vary from manual to semi-automatic. Once the bars are cut, they may be measured to check for the accuracy of sizing, and then distributed to the proper scheduling box.

At this point, the bars may be notched in a manner so that horizontal bars and vertical bars may be interlocked with each other. For example, a plurality of evenly spaced trapezoidal cuts may be made into the bottom surface of a horizontal bar. Similarly, a plurality of notches may be made in the top surface of the vertical bars. Alternatively, the horizontal bars may comprise notches in the upper surface of the bar and the vertical bars may comprise notches in the bottom surface of the bar. The notches in the vertical bars are positioned in such a manner as to mate with a similarly shaped notch in a horizontal bar so as to form a grid of at least one vertical bar and one horizontal bar.

Example 2

Preparation of the Window Sash and/or Door Panel

The window sash or door panel may be prepared using two vertically positioned stiles and two horizontal rails. Once aligned, the rails and stiles may be fastened at their corners using staples, pins, nails, or the like.

Once the two stiles and two rails are assembled, the assembled sash or panel may be glazed with a bonding agent or sealant such as silicone (e.g., Dow Corning 1191 Silicone). The type of sealant used may depend on the type of glass panel used for the window or door. Thus, sealants used for glass may differ from sealants used for a transparent plastic or other types of transparent panes. The sealant may act as an adhesive to facilitate securing the transparent panel in the sash. To apply the bonding agent, the pre-assembled sash (or door panel) may be placed in a robotic silicone applicator (e.g., Wegoma, Inc., or Besten, Inc.) which glazes the inside surface of the rails and stiles of the sash.

The transparent pane may then be placed in the sash similar to insertion of a picture into a picture frame. In one embodiment, the transparent pane is glass. The pane may be a single pane, or double-paned glass may be used. The transparent pane may be positioned so that each internal edge of the sash (e.g., each of two rails and each of two stiles) is adjacent to the transparent pane.

Next, the glass stop may be added to the window or door. The glass stop is generally a border that surrounds the transparent pane. The stop may cover the junction of the transparent pane and the sash as well as any visible sealant and thus, provides an attractive boundary around the glass. To position the glass stop, a second robotic applicator may be used to apply a sealant (e.g., silicone) around the perimeter of at least one surface of the transparent pane for application of the glass stop. The glass stop may be made of four strips of the material that is used for the window sash or door panel (e.g., wood, vinyl or aluminum). The strips may be applied around the perimeter of the glass and flush to the sash. The stops may be tapped into place (e.g., using a soft mallet) such that the silicone holds the stops adjacent to the glass surface. Then each stop can be fastened to the sash, by nailing or similar fastening means.

Example 3

Adding a Protrusion to the SDL Bar

The SDL bars of the present invention may then be shaped to form protruding wedge at the end of the bar (e.g., FIGS. 2 and 4). The protrusion may be made using circular saws that are able to cut along both the X and Y axes. In one embodiment, router motors with left hand and right hand cut 1/inch diameter router bits may be used.

Example 4

Notching of the Glass Stop, Sash, or Door Panel

A notching machine is used to notch the glass stop, window sash, or door panel for insertion of simulated divided light bars. The intent of the of the notching machine of the present invention is to punch the exact intersection locations of simulated divided light grille assemblies around the perimeter of the sash glazing stops.

A. Scheduling Control

A first step is to evaluate whether the window sash or door panel is for a simulated divided light panel. Many units built do not have interior grilles. Thus, not all of the window sash or door panels will be punched in this machine. These sashes will pass through the machine with no processing.

The punched locations are set according to a measurement of the actual glass opening between the glass stops along one vertical and one horizontal measurement axis. The accuracy of these punched locations will be ±0.015 of an inch. Servomotors power the horizontal and vertical sizing and clamping using precision ball screw drives and profiled linear rail and bearings. The servomotor drive system increases the speed of sizing and accuracy of clamping for the machine. Up to 2000 lbs of clamping force is available. Further, the clamping force may be used to meet the product requirements.

The notching machine can be computerized such that the notching schedule can be adjusted from a remote location. Network downloading gives the machine the ability to communicate with a network system for size information and other production parameters. The computer can download system ties into the production schedule allowing the machine to sequence sizes automatically at the conclusion of each machine cycle. If all the sashes are running sequential to the network, the machine will size automatically for the next unit. This option also allows the sequence to be interrupted for specials or one-of-a-kind runs.

B. Punch Modules

Four grille-marking punches are provided, one on each side of the sash. The marking punches shift into position using air cylinders and linear bearings. The punch tooling is a sharpened tool steel block to stamp each grille location. Air cylinders are used to drive the punches the correct depth into the wood stops. The punches are guided through a bushing type arrangement to ensure consistent positioning. To ensure the correct stops are punched in the right locations the system uses the information generated in the production scheduling software. A pair of servomotor driven systems drives the punch modules along the width and height of the sash, pausing to mark the sash as required.

The punch assemblies are mounted to overhead gantries that are mounted to the base machine framework. Precision rated ball screws or another suitable movement device are used to drive the punch assemblies along the width and height of the sash. The punch assemblies are driven in pairs using a common shaft to drive both modules at the same rate.

C. Glass Size Verification

A pair of sensors are used to check the daylight opening of the sash between the vertical and horizontal glass stops. One sensor can verify the actual width opening and another can verify the actual height opening. The punches are positioned according to the production schedule and according to the actual readings provided by the sizing sensors to position the intersecting grille assemblies as accurately as possible. The punches can be referenced off one side of the sash so that any tolerance build-up will be from the reference points.

D. Positioning Sash

A conveyor is mounted to the inside surface of the wing beams to convey the sash into the clamp assembly. The conveyor raises and lowers the sash into and out of the clamp nest using linear bearings synchronized with a spur gear and rack powered by air cylinders to provide a smooth consistent operation.

Clamp pads are located on each of the four corner base plates providing the square rest surfaces for clamping the outside of the window sash. To avoid marking the sash pieces, the edges of the clamp pads will have a radius where the product may touch. These clamp pads are machined and positioned on the base plates according to the sash dimensions provided.

Down clamps are located on each of the four base plates to provide downward force on each of the sash pieces. The sash pieces are held firmly against the clamp pads to increase consistency and accuracy of fastening as well as a flush joint on the face of the sash. Air cylinders, or equivalent, are used to provide the down clamping force.

Example 5

Positioning of Interlocking Muntin Grid within Sash

At this point, the SDL grid may be inserted into the sash. First, the transparent pane may be cleaned using a solvent such as silane or the like. Next, the tape backing is removed from the SDL grid. Generally, the tape is of such a nature such that it is possible to reposition the grid once or twice on the transparent pane if the tape has not been securely set.

It is essential that the grid be accurately positioned in the sash. Misaligning one part of the grid will cause other portions of the grid to be misaligned. Also, it is important that the operator prepare the light openings within the simulated divided light panel to be the correct size. If one set of openings is set too small, as for example at one end of the window, then the openings at the other end of the pane will be extended in length, and thus, too large. In previous systems, a telescopic gauge was used to position all four corners of the grid in relation to the sash. Thus, for smaller window units, each of the four corners of the grid was lightly positioned using a telescopic gauge set to have the proper dimensions of a single opening in the divided light grid to determine the accuracy of the positioning of the grid. If upon visual assessment the grid appeared to be accurately aligned, the grid was tapped down to secure the tape and fed into a roller press (Benfab) which presses the grid against the glass pane. For larger windows it was necessary to place shims, comprising thin strips or bars of Teflon® under the grid during the positioning process, to prevent the grid from becoming prematurely sealed to the glass during the positioning.

In contrast to prior systems, the SDL bars of the present invention are machined to form protruding wedge at the end of the bar (e.g., FIGS. 2 and 4). Thus, once the sash or door panel has been assembled and notched, the SDL grids may be snapped into the corresponding notches on the sash or door panel. Once emplaced, the SDL grid may be further secured to the transparent pane by feeding the assembled SDL window or door through a roller press as is known in the art.

It will be understood that each of the elements described above, or two or more together, may also find utility in applications different from the types described. While the invention has been illustrated and described as simulated divided light products and processes and systems for making the such products, it is not intended to be limited to the details shown, since various modifications and substitutions can be made without departing in any way from the spirit of the present invention. As such, further modifications and equivalents of the invention disclosed herein may occur to persons skilled in the art using no more than routine experimentation, and all such modifications and equivalents are believed to be within the spirit and scope of the invention as described herein.

That which is claimed:

1. A process for emplacing a simulated divided light bar on a panel comprising a transparent pane having a perimeter surrounded by a framework of stiles and rails, comprising the steps of:

(a) applying a glass stop along the perimeter of the transparent pane and covering a junction between the perimeter of the transparent pane and the framework;

(b) after applying the glass stop, making an aperture in the glass stop; and (c) inserting a first portion of a simulated divided light bar in the aperture, such that a second portion of the simulated divided light bar is positioned adjacent to, and divides at least part of, the transparent pane into at least two smaller sections.

2. The process of claim 1, wherein making the aperture comprises making a notch.

3. The process of claim 1, wherein the portion of the simulated divided light bar inserted into the aperture comprises a protrusion on the end of the bar.

4. The process of claim 1, wherein two apertures are made for each simulated divided light bar emplaced on the panel.

5. The process of claim 1, wherein at least two simulated divided light bars are attached to each other to form a grid prior to emplacing the bars on the panel.

6. The process of claim 5, wherein a plurality of apertures are made in the panel for insertion of a plurality of protrusions on the ends of a grid of simulated divided light bars.

7. The process of claim 6, wherein insertion of the protrusions on the ends of the plurality of simulated divided light bars into the apertures in the panel is substantially simultaneous.

8. The process of claim 1, wherein the panel having the aperture comprises a window sash, such that when the bar is emplaced, the window comprises a simulated divided light window.

9. The process of claim 1, wherein the panel further comprises a window sash such that when the bar is emplaced, the window sash comprises a simulated divided light window.

10. The process of claim 1, wherein the panel further comprises a door panel such that when the grid is emplaced, the door panel comprises a simulated divided light door.

11. The process of claim 1, wherein the glass stop is positioned adjacent to a door panel, such that when the bar is emplaced, the door panel comprises a simulated divided light door.

12. The process of claim 1, wherein the step of making the apertures in the panel is controlled at least in part by a computer.

13. An article of manufacture made by the process of claim 1.

14. A process for emplacing a grid of simulated divided light bars on a panel comprising a transparent pane, a pair of stiles and a pair of rails, the stiles and rails fastened together to form a framework surrounding a perimeter of the transparent pane, comprising the steps of:

(a) providing a plurality of simulated divided light bars wherein at least one bar comprises at least one end comprising a protrusion;

(b) assembling at least two of the simulated divided light bars to form a grid;

(c) positioning the transparent pane within the framework defined by the stiles and rails;

(d) installing a glass stop on the panel over a junction formed between the perimeter of the transparent pane and the framework;

(e) making an aperture in the glass stop;

(f) aligning the protrusion of the simulated divided light bars with the aperture in the glass stop; and (g) after installing the glass stop on the panel, inserting at least a portion of the protrusion of the simulated divided light bars into the aperture in the glass stop, such that the grid is emplaced adjacent to, and divides at least part of, the transparent pane into a plurality of smaller sections.

15. The process of claim 14, wherein step (e) of making the apertures in the glass stop is controlled at least in part by a computer.

16. The process of claim 14, wherein a plurality of apertures are made in the glass stop for insertion of a plurality of protrusions on the ends of a grid of simulated divided light bars.

17. The process of claim 16, wherein insertion of the protrusions on the ends of the plurality of simulated divided light bars into the corresponding apertures in the glass stop is substantially simultaneous.

18. The process of claim 14, wherein the panel further comprises a window sash, such that when the bar is emplaced, the window sash comprises a simulated divided light window.

19. The process of claim 14, wherein the glass stop is positioned adjacent to a window sash, such that when the bar is emplaced, the window sash comprises a simulated divided light window.

20. The process of claim 14, wherein the panel further comprises a door panel such that when the grid is emplaced, the door panel comprises a simulated divided light door.

21. The process of claim 15, wherein the glass stop is positioned adjacent to a door panel, such that when the bar is emplaced, the door panel comprises a simulated divided light door.

22. An article of manufacture made by the process of claim 14.

* * * * *

UNITED STATES PATENT AND TRADEMARK OFFICE

CERTIFICATE OF CORRECTION

PATENT NO. : 7,854,097 B2
APPLICATION NO. : 11/035544
DATED : December 21, 2010
INVENTOR(S) : Omer Theodore Schlyper et al.

It is certified that error appears in the above-identified patent and that said Letters Patent is hereby corrected as shown below:

On the bibliographic page, in the Abstract, line 2, please delete “the”.

In Column 2, line 21, please delete “the”.

In Column 5, line 1, please delete “the”.

In Column 6, line 12, after “may”, please insert --be--.

In Column 7, line 63, after “may”, please insert --be--.

In Column 8, line 41, after “plurality”, please insert --of--.

In Column 10, line 32, please change “overly” to --overlay--.

In Column 12, line 49, after “may”, please insert --be--.

In Column 12, line 62, after “made”, please delete “the”.

In Column 12, line 62, please delete “is used of”.

In Column 17, line 34, please change “notch(s)” to --notch(es)--.

In Column 17, line 37, please change “notch(s)” to --notch(es)--.

In Column 17, line 41, please change “notch(s)” to --notch(es)--.

In Column 17, line 44, please change “notch(s)” to --notch(es)--.

In Column 17, line 64, please change “or” to --of--.

In Column 20, line 42, after “then”, please insert --be--.

In Column 20, line 49, please change “assesses” to --assess--.

Signed and Sealed this
Twenty-ninth Day of March, 2011

David J. Kappos

David J. Kappos
*Director of the United States Patent and Trademark Office*

In Column 20, line 50, please change “determines” to --determine--.

In Column 20, line 56, after “then”, please insert --be--.

In Column 22, line 67, please delete “of the” the second time it occurs.

In Column 23, line 26, please replace “ties” with --sizes--.

In Column 24, line 25, please delete “such” the second time it occurs.

In Column 24, line 61, please delete “the”.